US007071905B1

(12) United States Patent
Fan

(10) Patent No.: US 7,071,905 B1
(45) Date of Patent: Jul. 4, 2006

(54) ACTIVE MATRIX DISPLAY WITH LIGHT EMITTING DIODES

(76) Inventor: Nong-qiang Fan, P.O. Box 280763, San Francisco, CA (US) 94128-0763

( * ) Notice: Subject to any disclaimer, the term of this patent is extended or adjusted under 35 U.S.C. 154(b) by 29 days.

(21) Appl. No.: 10/887,996

(22) Filed: Jul. 9, 2004

Related U.S. Application Data

(60) Provisional application No. 60/487,430, filed on Jul. 14, 2003, provisional application No. 60/486,534, filed on Jul. 9, 2003.

(51) Int. Cl.
*G09G 3/30* (2006.01)

(52) U.S. Cl. ..... 345/76; 345/83; 315/169.3

(58) Field of Classification Search ..... 345/74.1–83; 315/169.3
See application file for complete search history.

(56) References Cited

U.S. PATENT DOCUMENTS 6,288,696 B1 * 9/2001 Holloman ..... 345/84
2002/0101172 A1 8/2002 Bu
2004/0100430 A1 5/2004 Fruehauf
2005/0140607 A1 * 6/2005 Sato et al. ..... 345/76

FOREIGN PATENT DOCUMENTS

JP 2002091377 A * 3/2003
WO WO 2004034364 A1 * 4/2004

* cited by examiner

*Primary Examiner*—Alexander Eisen

(57) ABSTRACT

A pixel element in the matrix of pixel elements includes a light emitting diode, a resistor electrically connecting to the light emitting diode, a data input, and a sensing output. The data input receives a data signal that changes a current flowing through the light emitting diode when the data input is enabled. The sensing output generates a sensing signal when the sensing output is enabled. The sensing output generates substantially no sensing signal when the sensing output is disabled. A change in a current flowing through both the light emitting diode and the resistor induces a change in the sensing signal.

105 Claims, 15 Drawing Sheets

ACTIVE MATRIX DISPLAY WITH LIGHT EMITTING DIODES

RELATED APPLICATIONS

This application claims the benefit of U.S. Provisional Application No. 60/486,534, filed on Jul. 9, 2003, and U.S. Provisional Application No. 60/487,430, filed on Jul. 14, 2003.

BACKGROUND

The present invention relates generally to active matrix displays, and more particularly to active matrix displays having light emitting diodes.

FIG. 1A shows a section of an active matrix display with pixel elements including light emitting diodes. The section of an active matrix display in FIG. 1A includes a matrix of pixel elements, an array of selection driving lines, and an array of data driving lines that is essentially perpendicular to the array of selection driving lines. A pixel element 100 generally is connected to a selection driving line 300 and a data driving line 200.

As shown in FIG. 1B, a pixel element 100 includes a light emitting diode 110, a biasing transistor 50, a switching transistor 40, and a capacitor 48. Biasing transistor 50 has a gate 55, a first terminal 52, and a second terminal 54. Gate 55 is connected to capacitor 48, first terminal 52 is connected to light emitting diode 110, and second terminal 54 is connected to a common voltage $V_z$. Capacitor 48 is also connected to common voltage $V_z$. In addition to connecting to first terminal 52, light emitting diode 110 is connected a common voltage $V_e$. Switching transistor 40 has a gate 45, a first terminal 42, and a second terminal 44. Gate 45 is connected to a selection driving line 300, first terminal 42 is connected to a data driving line 200, and second terminal 44 is connected to gate 55 of biasing transistor 50.

During operation, pixel element 100 generally can be either in a data-setting mode or in a light-emitting mode. When pixel element 100 is in the data-setting mode, a selection signal (e.g., a selection voltage) on selection driving line 300 drives switching transistor 40 into a conducting state. When switching transistor 40 is in the conducting state, a semiconductor channel between first terminal 42 and second terminal 44 is essentially conductive, and a data signal (e.g., a data voltage) on data driving line 200 can set a gate voltage at gate 55 of biasing transistor 50 to a target voltage value. When pixel element 100 is in the light-emitting mode, a deselect signal (e.g., a deselect voltage) on selection driving line 300 drives switching transistor 40 into a non-conducting state. When switching transistor 40 is in the non-conducting state, a semiconductor channel between first terminal 42 and second terminal 44 is essentially non-conductive, and a gate voltage at gate 55 of biasing transistor 50 can be substantially maintained.

In general, a driving current $I_0$ passing through light emitting diode 110 is determined by the gate voltage at gate 55 of biasing transistor 50. But, the driving current $I_0$ passing through light emitting diode 110 also depends on some properties of biasing transistor 50. The biasing transistor 50 in different pixel element 100 may have different properties. Therefore, in certain applications, it is desirable to provide a pixel element 100 that includes a sensing output that may provide some measurement on the driving current $I_0$ when the sensing output is enabled.

SUMMARY

In one aspect, an active matrix display includes an array of selection driving lines, an array of data driving lines crossing the array of selection driving lines, an array of sensing output lines crossing the array of selection driving lines, and a matrix of pixel elements. A pixel element in the matrix of pixel elements includes a first switching transistor, a second switching transistor, a biasing transistor, a storage capacitor, a light emitting diode, and a resistor. The first switching transistor has a gate, a source, and a drain, and a semiconductor channel between the source and the drain. The gate of the first switching transistor electrically connects to a selection driving line. The second switching transistor has a gate, a source, and a drain, and a semiconductor channel between the source and the drain. The gate of the second switching transistor electrically connects to a selection driving line. The biasing transistor has a gate, a source, and a drain, and a semiconductor channel between the source and the drain. The gate of the biasing transistor electrically connects to a data driving line through the semiconductor channel of the first switching transistor. The storage capacitor electrically connects to the gate of the biasing transistor. The light emitting diode electrically connects to the semiconductor channel of the biasing transistor. The resistor has a first terminal and a second terminal. The first terminal of the resistor electrically connects to the light emitting diode. The second terminal of the resistor electrically connects to a common voltage. The first terminal of the resistor electrically connects to a sensing output line through the semiconductor channel of the second switching transistor.

In another aspect, an active matrix display includes an array of selection driving lines, an array of data driving lines crossing the array of selection driving lines, an array of sensing output lines crossing the array of selection driving lines, and a matrix of pixel elements. A pixel element in the matrix of pixel elements includes a first switching transistor, a second switching transistor, a biasing transistor, a storage capacitor, a light emitting diode, and a resistor. The first switching transistor has a gate, a source, and a drain, and a semiconductor channel between the source and the drain. The gate of the first switching transistor electrically connects to a selection driving line. The second switching transistor has a gate, a source, and a drain, and a semiconductor channel between the source and the drain. The gate of the second switching transistor electrically connects to a selection driving line. The biasing transistor has a gate, a source, and a drain, and a semiconductor channel between the source and the drain. The gate of the biasing transistor electrically connects to a data driving line through the semiconductor channel of the first switching transistor. The storage capacitor electrically connects to the gate of the biasing transistor. The light emitting diode electrically connects to the semiconductor channel of the biasing transistor. The resistor serially connects to the light emitting diode and forms a compound component having a first terminal and a second terminal. The second terminal of the compound component electrically connects to a common voltage. The first terminal of the compound component electrically connects to a sensing output line through the semiconductor channel of the second switching transistor.

In another aspect, an active matrix display includes an array of selection driving lines, an array of data driving lines crossing the array of selection driving lines, an array of sensing output lines crossing the array of selection driving lines, and a matrix of pixel elements. A pixel element in the matrix of pixel elements electrically connects to at least one selection driving line and electrically connects to at least one data driving line. The pixel element includes a biasing transistor, a light emitting diode, a resistor, a monitoring point, and a sensing output. The biasing transistor has a gate, a source, and a drain, and a semiconductor channel between the source and the drain. The light emitting diode electrically connects to the semiconductor channel of the biasing transistor. The resistor electrically connects to the light emitting diode. The monitoring point is on a current path that passes through at least the light emitting diode and the resistor. The sensing output electrically connects to a sensing output line. The sensing output receives a sensing signal from the monitoring point when the sensing output is enabled.

In another aspect, an active matrix display includes an array of selection driving lines, an array of data driving lines crossing the array of selection driving lines, an array of sensing output lines crossing the array of selection driving lines, and a matrix of pixel elements. A pixel element in the matrix of pixel elements electrically connects to at least one selection driving line. The pixel element includes a light emitting diode, a resistor electrically connecting to the light emitting diode, a data input, and a sensing output. The data input electrically connects to a data driving line. The data input receives a data signal that changes a current flowing through the light emitting diode when the data input is enabled. The sensing output electrically connects to a sensing output line. The sensing output generates a sensing signal when the sensing output is enabled. The sensing output generates substantially no sensing signal when the sensing output is disabled. A change in a current flowing through both the light emitting diode and the resistor induces a change in the sensing signal.

The active matrix display described herein can further include a plurality of feedback data drivers. A feedback data driver electrically connects to a data driving line and a sensing output line. The data driving line and the sensing output line connect to a column of pixel elements. The feedback data driver detects a sensing signal on the sensing output line and outputs a data signal on the data driving line. When a given pixel element is selected from the column of pixel elements, the feedback data driver is operable to drive the given pixel element in a negative feedback loop.

In another aspect, a method is applied on an active matrix display. The active matrix display includes an array of selection driving lines, an array of data driving lines crossing the array of selection driving lines, an array of sensing output lines crossing the array of selection driving lines, and a matrix of pixel elements. A pixel element in the matrix of pixel elements includes a light emitting diode, a resistor electrically connecting to the light emitting diode, a monitoring point, a sensing output, a data input, and at least one selection input. The monitoring point is on a current path that passes through at least the light emitting diode and the resistor. The sensing output receives a sensing signal from the monitoring point when the sensing output is enabled. The sensing output electrically connects to a sensing output line. The data input is operable to change a current flowing through the light emitting diode when the data input is enabled. The data input electrically connects to a data driving line. The at least one selection input electrically connects to a selection driving line. The method applied on the active matrix display includes (1) selecting a row of pixel elements in the matrix of pixel elements, and (2) driving a given pixel element in the selected row with a feedback data driver in a negative feedback loop.

Selecting a row of pixel elements can include applying a selection signal to a selection driving line that electrically connects to the selection inputs of the pixel elements in the selected row.

Driving a given pixel element in the selected row with a feedback data driver in a negative feedback loop includes the following: (1) receiving with the feedback data driver a sensing signal from a sensing output line electrically connecting to the sensing output of the given pixel element, (2) generating with the feedback data driver a data signal that depends on the sensing signal received from the given pixel element, and (3) transmitting with the feedback data driver a data signal to a data driving line electrically connecting to the data input of the given pixel element to complete the negative feedback loop. When driving a given pixel element in the selected row in a negative feedback loop, the sensing signal received with the feedback data driver is related to a current flowing through both the light emitting diode and the resistor in the given pixel element.

In another aspect, a method is applied on an active matrix display. The active matrix display includes an array of selection driving lines, an array of data driving lines crossing the array of selection driving lines, an array of sensing output lines crossing the array of selection driving lines, and a matrix of pixel elements. A pixel element in the matrix of pixel elements includes a light emitting diode, a resistor electrically connecting to the light emitting diode, a monitoring point, a sensing output, a data input, and at least one selection input. The monitoring point is on a current path that passes through at least the light emitting diode and the resistor. The sensing output receives a sensing signal from the monitoring point when the sensing output is enabled. The sensing output electrically connects to a sensing output line. The data input is operable to change a current flowing through the light emitting diode when the data input is enabled. The data input electrically connects to a data driving line. The at least one selection input electrically connects to a selection driving line. The method applied on the active matrix display includes (1) selecting a row of pixel elements in the matrix of pixel elements, and (2) measuring a given pixel element in the selected row with a sensing detector that receives a sensing signal on a sensing output line electrically connecting to the sensing output of the given pixel element. When measuring a given pixel element in the selected row, the sensing signal is related to a current flowing through both the light emitting diode and the resistor in the given pixel element.

Implementations of the invention may include one or more of the following advantages. Certain property of a pixel element in an active matrix display can be measured. A pixel element in an active matrix display can be driven in a negative feedback loop to compensate some variations in certain property of the pixel element.

Additional advantages of the invention will be set forth in the description which follows, and in part will be obvious from the description, or may be learned by practice of the invention. The advantages of the invention may be realized by means of the instrumentalities and combinations particularly pointed out in the claims.

BRIEF DESCRIPTION OF THE DRAWINGS

The present invention will be understood more fully from the detailed description and accompanying drawings of the invention set forth herein. However, the drawings are not to be construed as limiting the invention to the specific embodiments shown and described herein. Like reference numbers are designated in the various drawings to indicate like elements.

DETAILED DESCRIPTION

A. Pixel Elements in Active Matrix Display

Figure 1A:
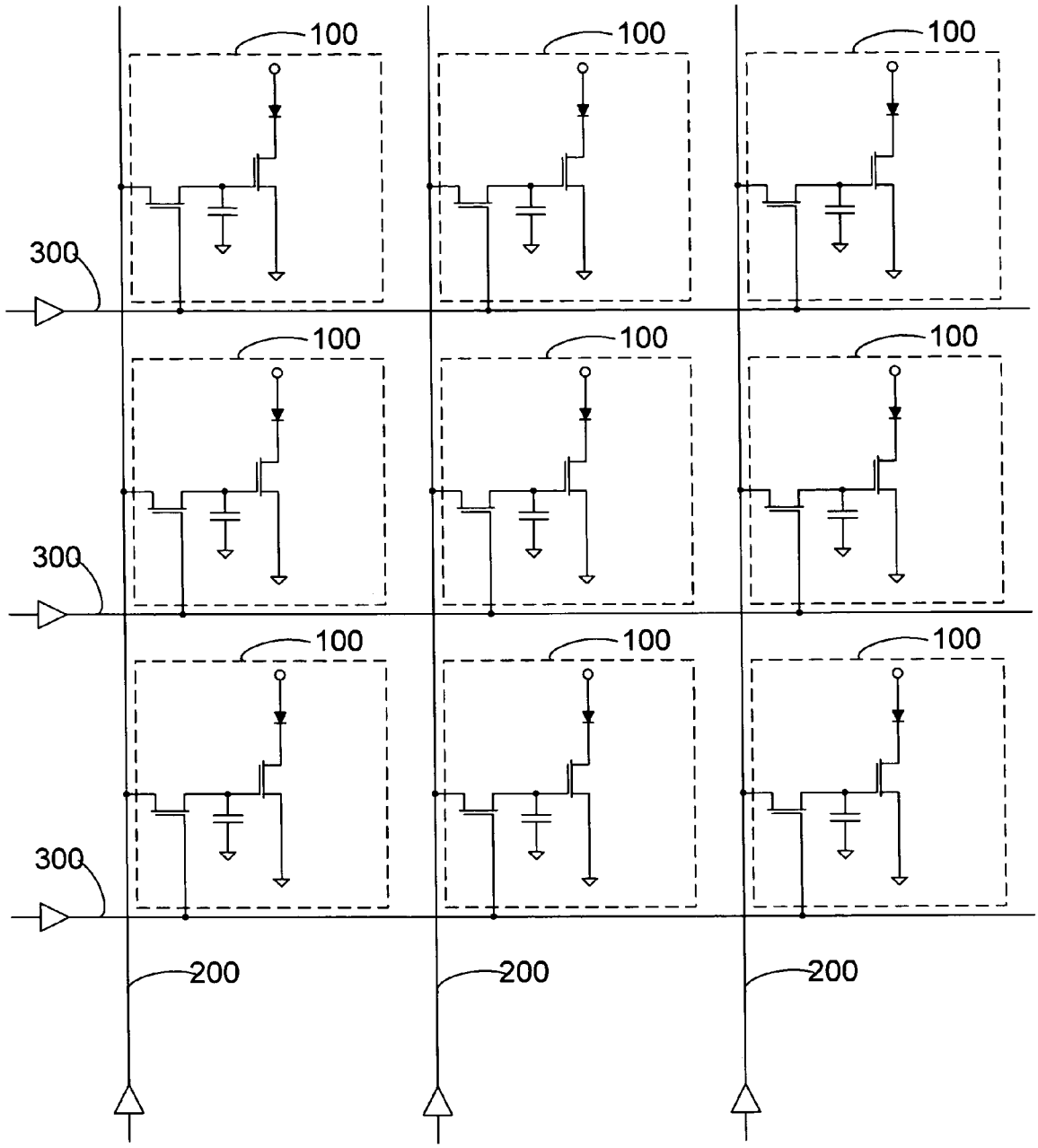
FIG. 1A shows a section of an active matrix display with pixel elements including light emitting diodes.
Figure 1B:
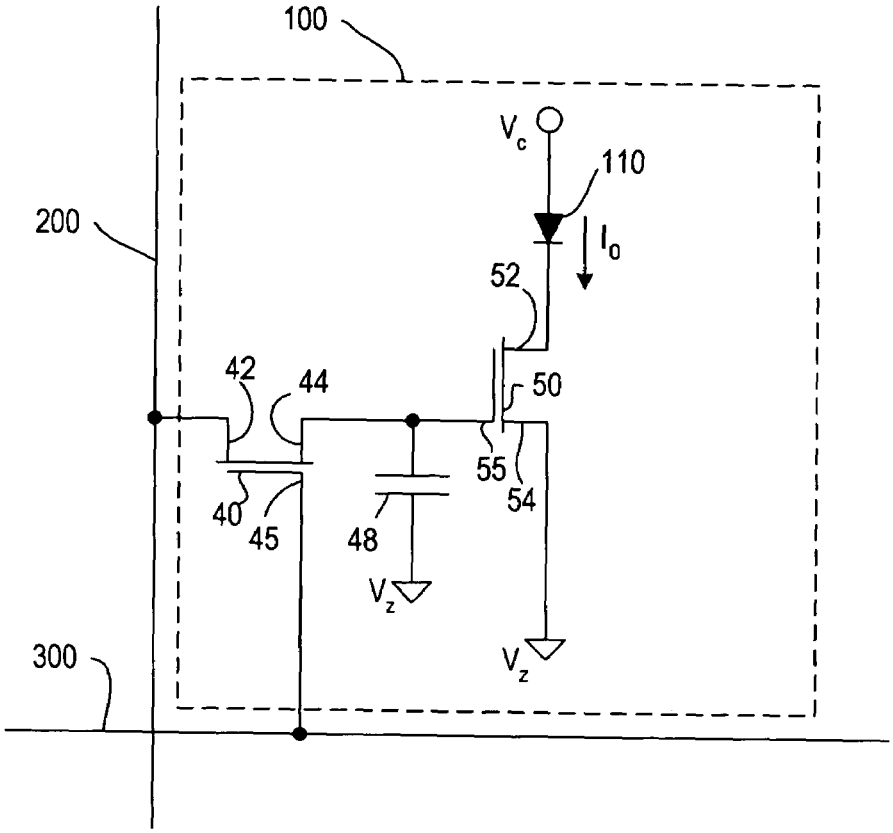
FIG. 1B shows a pixel element having a light emitting diode.
Figure 2A:
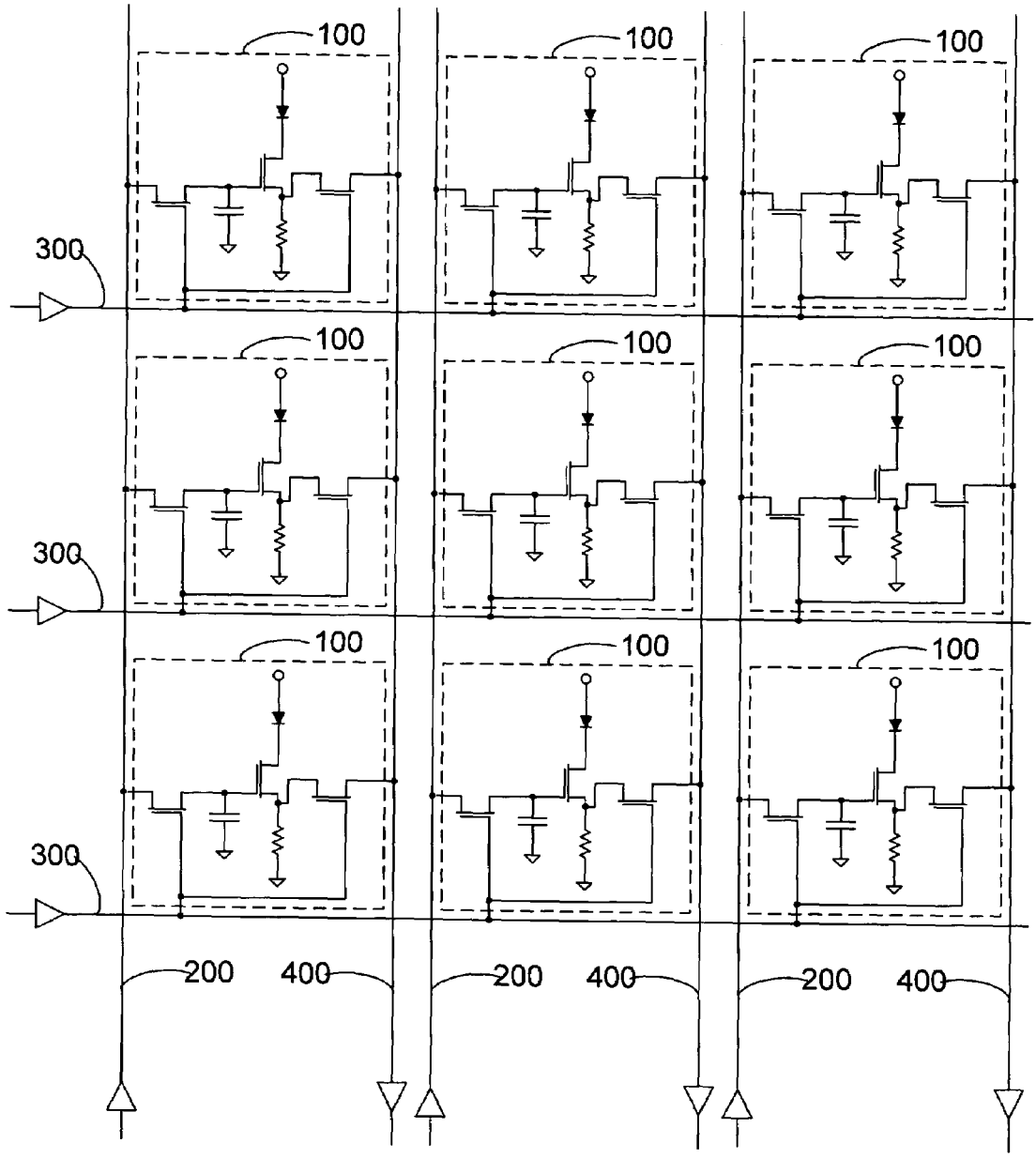
FIG. 2A shows a section of an active matrix display with pixel elements including light emitting diodes and sensing outputs.

FIG. 2A shows a section of an active matrix display with pixel elements including light emitting diodes and sensing outputs. The section of an active matrix display in FIG. 2A includes a matrix of pixel elements, an array of selection driving lines, an array of data driving lines, and an array of sensing output lines. The array of data driving lines is essentially perpendicular to the array of selection driving lines. The array of sensing output lines is essentially in parallel with the array of data driving lines. A pixel element 100 generally is connected to a selection driving line 300, a data driving line 200, and a sensing output line 400.

Figure 2B:
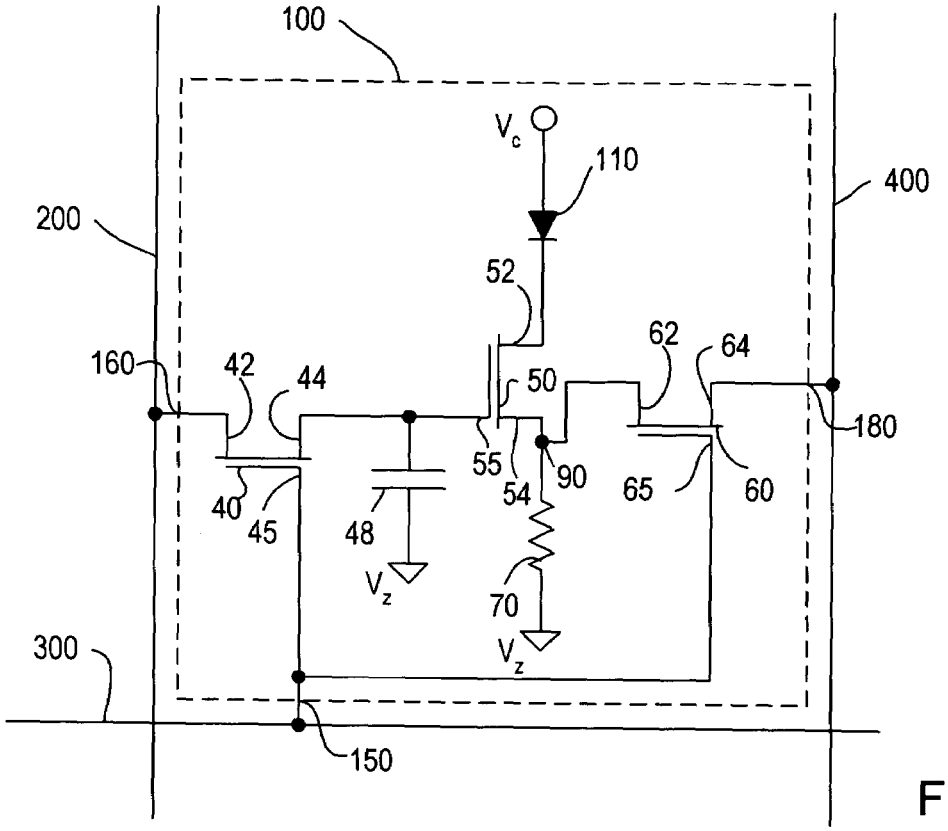
FIG. 2B shows a pixel element having a light emitting diode and a sensing output.

As shown in FIG. 2B, a pixel element 100 includes a light emitting diode 110, a biasing transistor 50, a switching transistor 40, a capacitor 48, a switching transistor 60, and a resistor 70. Biasing transistor 50 has a gate 55, a first terminal 52, and a second terminal 54. Gate 55 is connected to capacitor 48, first terminal 52 is connected to light emitting diode 110, and second terminal 54 is connected to resistor 70. Resistor 70 is connected to a common voltage $V_z$. Capacitor 48 is also connected to the common voltage $V_z$. In addition to connecting to first terminal 52 of biasing transistor 50, light emitting diode 110 is connected a common voltage $V_c$. Switching transistor 40 has a gate 45, a first terminal 42, and a second terminal 44. Gate 45 is connected to a selection driving line 300, first terminal 42 is connected to a data driving line 200, and second terminal 44 is connected to gate 55 of biasing transistor 50. Switching transistor 60 has a gate 65, a first terminal 62, and a second terminal 64. Gate 65 is connected to a selection driving line 300, first terminal 62 of switching transistor 60 is connected to a monitoring point 90, and second terminal 64 is connected to a sensing output line 400. In FIG. 2B, monitoring point 90 is between resistor 70 and second terminal 54 of biasing transistor 50.

During operation, pixel element 100 generally can be either in a data-setting mode or in a light-emitting mode. When pixel element 100 is in the data-setting mode, a selection signal (e.g., a selection voltage) on selection driving line 300 drives switching transistor 40 into a conducting state. When switching transistor 40 is in the conducting state, a semiconductor channel between first terminal 42 and second terminal 44 is essentially conductive, and a data signal (e.g., a data voltage) on data driving line 200 can set a gate voltage at gate 55 of biasing transistor 50 to a target voltage value. When pixel element 100 is in the light-emitting mode, a deselect signal (e.g., a deselect voltage) on selection driving line 300 drives switching transistor 40 into a non-conducting state. When switching transistor 40 is in the non-conducting state, a semiconductor channel between first terminal 42 and second terminal 44 is essentially non-conductive, and a gate voltage at gate 55 of biasing transistor 50 can be substantially maintained.

Pixel element 100 generally includes a selection input 150, a data input 160, and a sensing output 180. Selection input 150 can receive a selection signal from selection driving line 300. Data input 160 can receive a data signal from data driving line 200. A data signal generally can change a gate voltage at gate 55 of biasing transistor 50 when pixel element 100 is selected with a selection signal received at selection input 150. Sensing output 180 generally can output a sensing signal when sensing output 180 is enabled with a selection signal received at selection input 150.

In operation, a selection signal (e.g., a selection voltage) on selection driving line 300 drives switching transistor 60 into a conducting state. When switching transistor 60 is in the conducting state, a semiconductor channel between first terminal 62 and second terminal 64 is essentially conductive, and a voltage at sensing output 180 can be substantially close to the voltage at the monitoring point 90.

In general, a driving current $I_0$ passing through light emitting diode 110 is determined by the gate voltage at gate 55 of biasing transistor 50. In FIG. 2B, the driving current $I_0$ passing through light emitting diode 110 is essentially the same as the current passing though resistor 70. Therefore, a voltage $V_m$ at the monitoring point 90 is related to the driving current $I_0$. More specifically, $V_m = R\ I_0 + V_z$, where R is the resistance of resistor 70. When sensing output 180 is enabled, the sensing signal at sensing output 180 provide a convenient measurement of the driving current $I_0$ passing through light emitting diode 110. The driving current $I_0$ is determined with the equation, $I_0 = (V_m - V_z)/R$.

Figure 3:
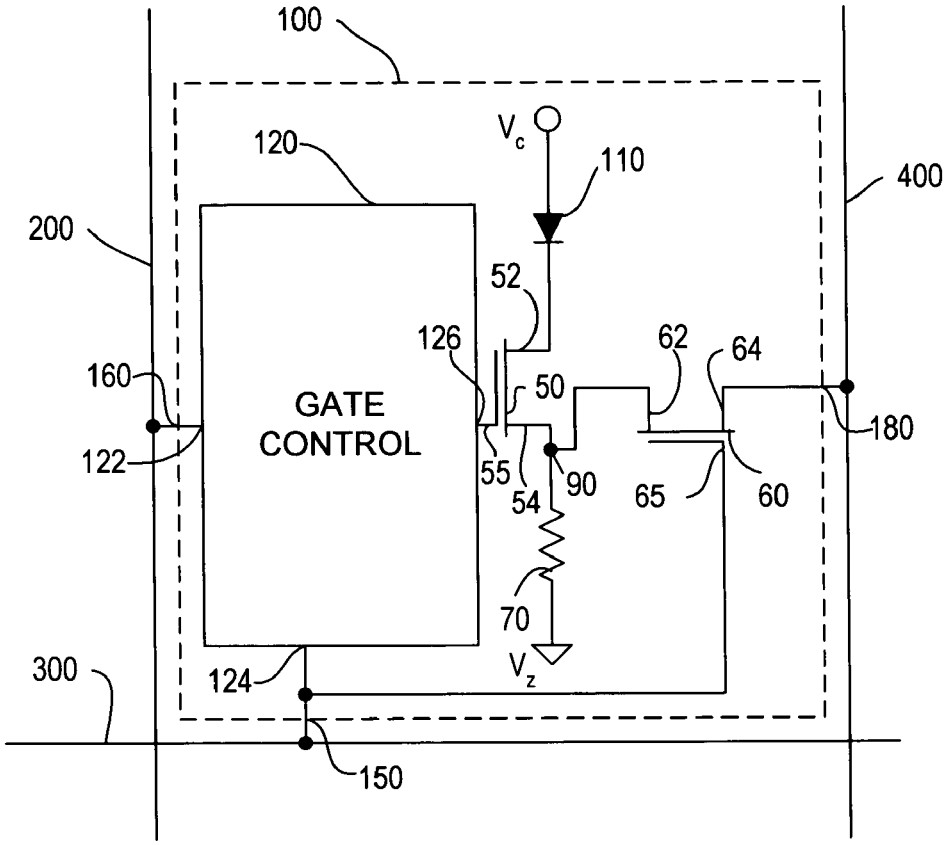
FIG. 3 shows a generic implementation of a pixel element having a light emitting diode and a sensing output.

FIG. 3 shows a generic implementation of pixel element 100. In FIG. 3, a pixel element 100 includes a light emitting diode 110, a biasing transistor 50, a switching transistor 60, a resistor 70, and a gate control circuit 120. Gate control circuit 120 includes a gate control input 122, a gate control output 126, and a gate control enabling input 124. Gate control input 122 can receive a data signal from a data driving line 200. Gate control enabling input 124 can receive a selection signal from a selection driving line 300. Gate control output 126 is connected to a gate 55 of biasing transistor 50. A first terminal 52 of biasing transistor 50 is connected to light emitting diode 110. A second terminal 54 of biasing transistor 50 is connected to resistor 70. Resistor 70 is connected to a common voltage $V_z$. In addition to connecting to first terminal 52 of biasing transistor 50, light emitting diode 110 is connected a common voltage $V_c$. Switching transistor 60 has a gate 65, a first terminal 62, and a second terminal 64. Gate 65 is connected to a selection driving line 300, first terminal 62 of switching transistor 60 is connected to a monitoring point 90, and second terminal 64 is connected to a sensing output line 400. In FIG. 3, monitoring point 90 is between resistor 70 and second terminal 54 of biasing transistor 50.

During operation, pixel element 100 generally can be either in a data-setting mode or in a light-emitting mode. When pixel element 100 is in the data-setting mode, Gate control circuit 120 receives a selection signal from selection driving line 300. The selection signal received by gate control circuit 120 enables gate control output 126. When gate control output 126 is enabled, a voltage at gate control output 126 generally depend on a data signal received at gate control input 122. Consequently, a data signal received by gate control circuit 120 from data driving line 200 can set a gate voltage at gate 55 of biasing transistor 50 to a target voltage value.

When pixel element 100 is in the light-emitting mode, gate control circuit 120 receives a deselect signal from selection driving line 300. The deselect signal received by gate control circuit 120 disables gate control output 126. When gate control output 126 is disabled, a voltage at gate control output 126 is substantially independent from data signals at gate control input 122. Consequently, a gate voltage at gate 55 of biasing transistor 50 can be substantially maintained.

Pixel element 100 generally includes a selection input 150, a data input 160, and a sensing output 180. Selection input 150 can receive a selection signal from selection driving line 300. Data input 160 can receive a data signal from data driving line 200. A data signal received at data input 160 generally can change a gate voltage at gate 55 of biasing transistor 50 when pixel element 100 is selected with a selection signal received at selection input 150. Sensing output 180 generally can output a sensing signal when sensing output 180 is enabled with a selection signal received at selection input 150.

In operation, a selection signal (e.g., a selection voltage) on selection driving line 300 drives switching transistor 60 into a conducting state. When switching transistor 60 is in the conducting state, a semiconductor channel between first terminal 62 and second terminal 64 is essentially conductive, and a voltage at sensing output 180 can be substantially close to the voltage at monitoring point 90. When sensing output 180 is enabled, the sensing signal at sensing output 180 provide a convenient measurement of the driving current $I_0$ passing through light emitting diode 110. In an implementation as shown in FIG. 3, the current $I_0$ passing through light emitting diode 110 is determined with the equation, $I_0=(V_m-V_z)/R$, where R is the resistance of resistor 70, and $V_m$ is the voltage at sensing output 180 when sensing output 180 is enabled.

Figure 4A:
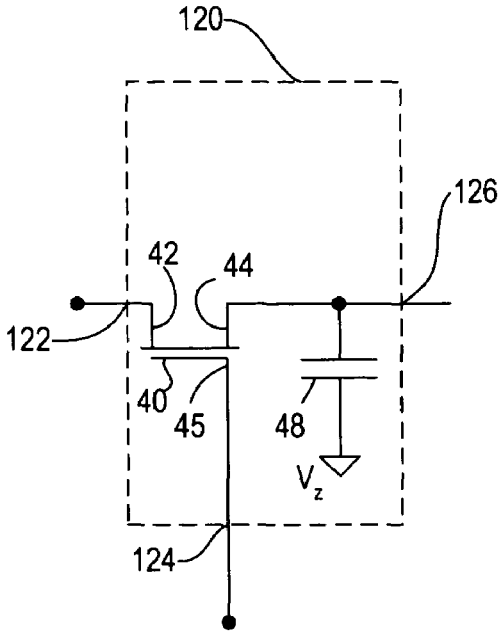
FIGS. 4A–4C are three exemplary implementations of a gate control circuit.
Figure 4B:
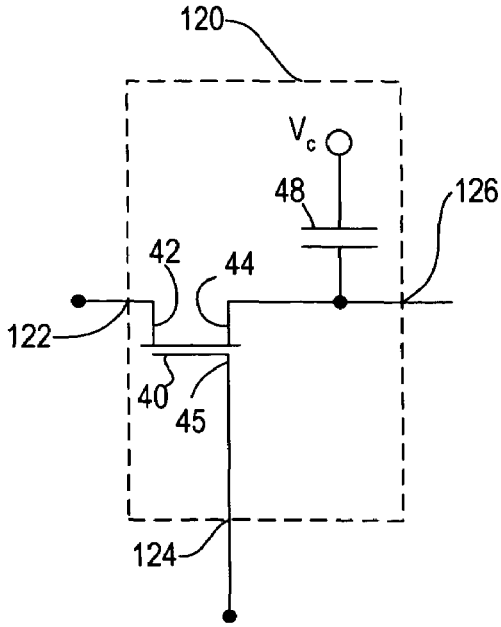
Figure 4C:
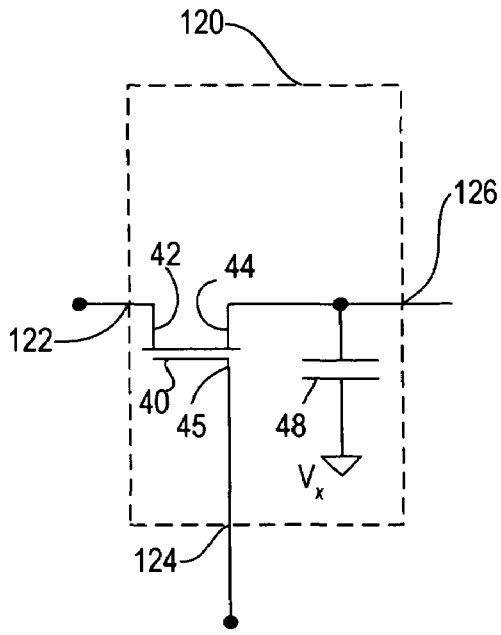

A gate control circuit 120 generally includes at least one gate control input, at least one gate control output, and at least one gate control enabling input. Gate control circuit 120 can be implemented in many different ways. FIGS. 4A–4C show three exemplary implementations of gate control circuit 120.

In FIG. 4A, gate control circuit 120 includes a switching transistor 40 and a capacitor 48. Switching transistor 40 has a gate 45, a first terminal 42, and a second terminal 44. Gate 45 is connected to a gate control enabling input 124. First terminal 42 is connected to a gate control input 122. Second terminal 44 is connected to a gate control output 126. Second terminal 44 is also connected to a first terminal of capacitor 48. A second terminal of capacitor 48 is connected to a common voltage $V_z$. When gate control circuit 120 is used in pixel element 100 as shown in FIG. 3, the second terminal of capacitor 48 can be connected to the same common voltage $V_z$ that resistor 70 is connected to.

In FIG. 4B, gate control circuit 120 is almost the same as the gate control circuit 120 in FIG. 4A, with the exception that a second terminal of capacitor 48 is connected to a common voltage $V_c$. When gate control circuit 120 is used in pixel element 100 as shown in FIG. 3, the second terminal of capacitor 48 can be connected to the same common voltage $V_c$ that light emitting diode 110 is connected to.

In FIG. 4C, gate control circuit 120 is almost the same as the gate control circuit 120 in FIG. 4A, with the exception that a second terminal of capacitor 48 is connected to a common voltage $V_x$. When gate control circuit 120 is used in pixel element 100 as shown in FIG. 3, common voltage $V_x$ can be different from common voltage $V_z$ that resistor 70 is connected to and different from common voltage $V_c$ that light emitting diode 110 is connected to.

Figure 4D:
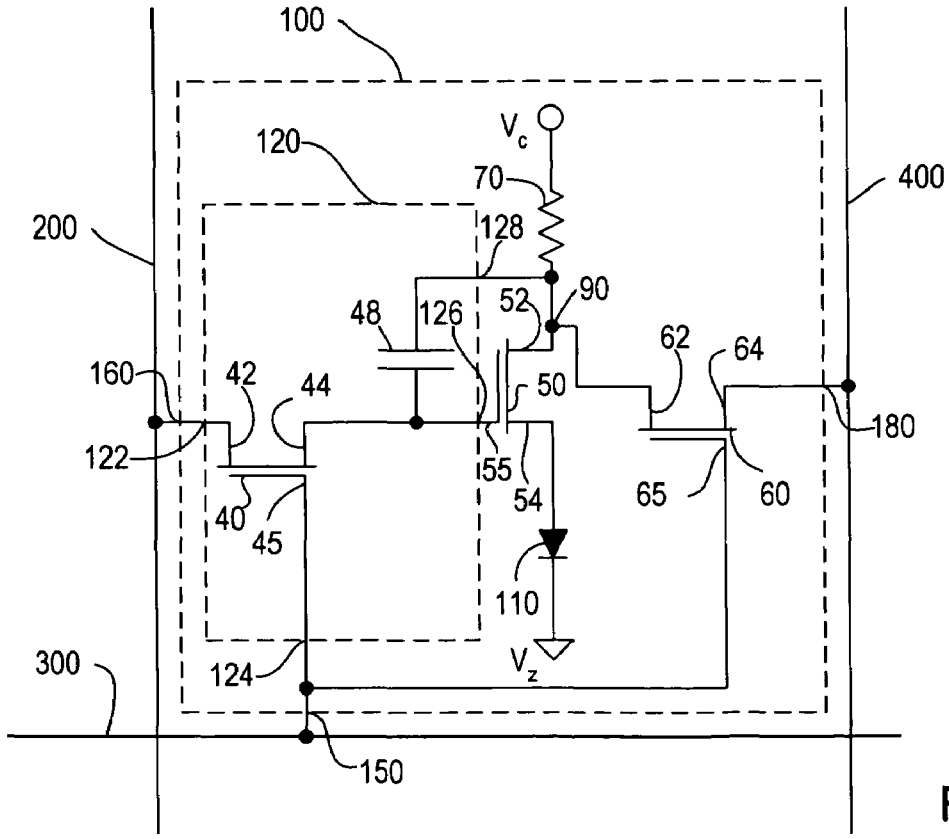
FIG. 4D shows a gate control circuit that has an additional terminal.

In addition to the exemplary implementations of gate control circuit 120 as shown in FIGS. 4A–4C, other implementations of gate control circuit 120 can be found in literatures or can be designed by people skilled in the art. In general, gate control circuit 120 can include additional transistors, capacitors, or resistors in additional to switching transistor 40 and capacitor 48. Gate control circuit 120 can also include additional terminals for signal input, signal output, or enabling input. As an example, FIG. 4D shows a gate control circuit 120 that has an additional terminal 128.

With a specific implementation of gate control circuit 120, pixel element 100 can be implemented in many different ways. In additional to the implementation of pixel element 100 as shown in FIG. 3, three more exemplary implementations of pixel element 100 are shown in FIGS. 5A–5C.

Figure 5A:
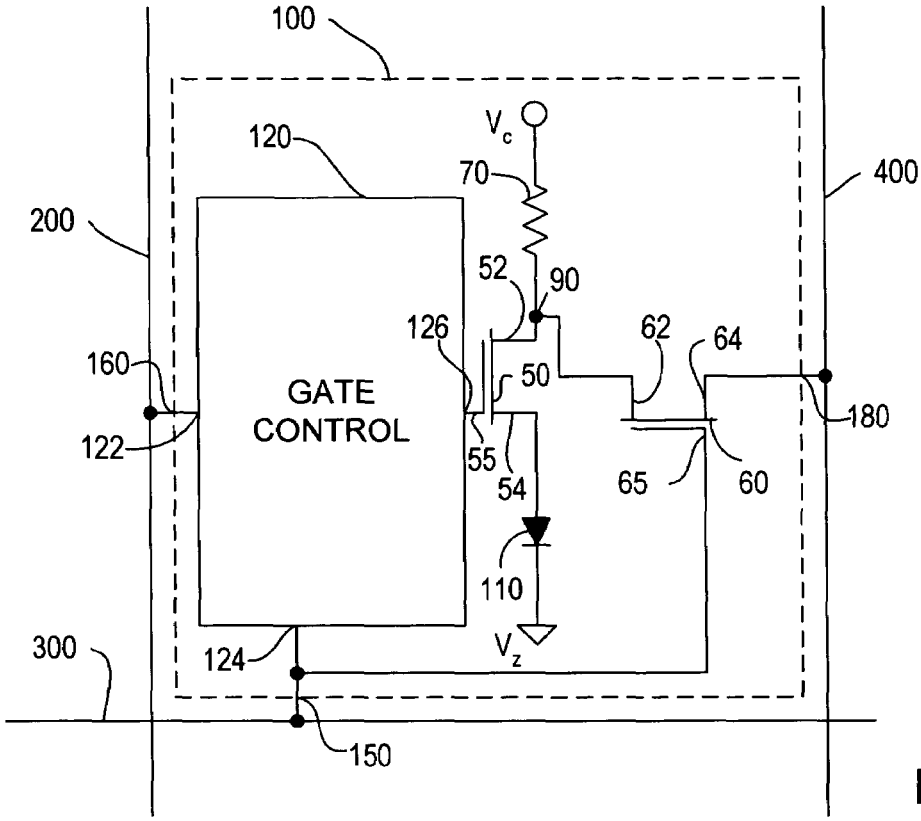
FIGS. 5A–5C are three exemplary implementations of a pixel element having a light emitting diode and a sensing output.
Figure 5B:
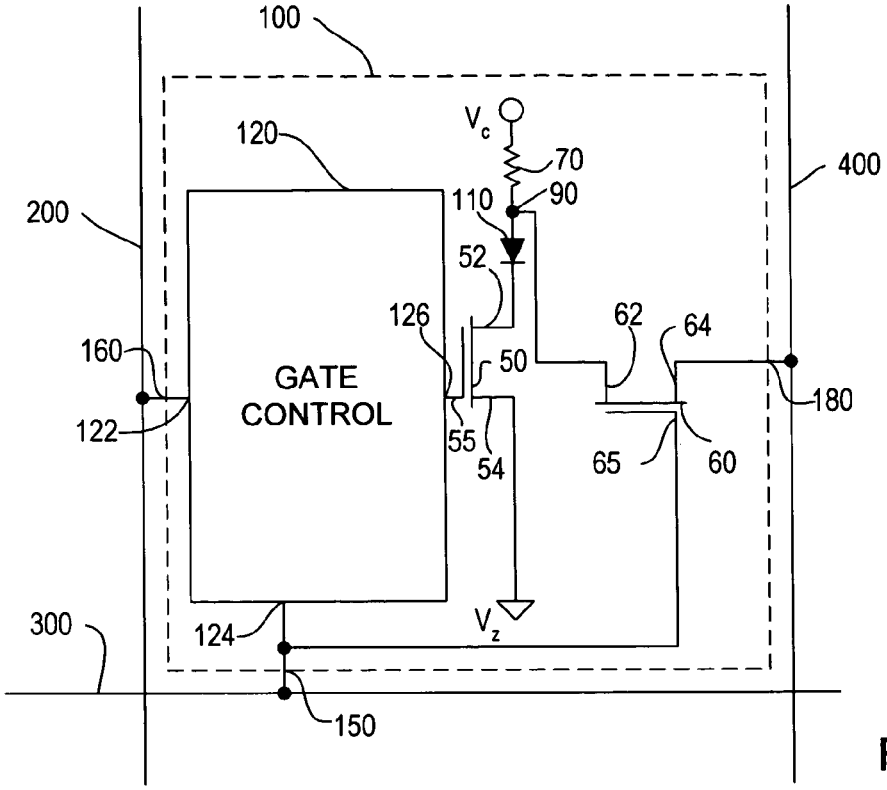
Figure 5C:
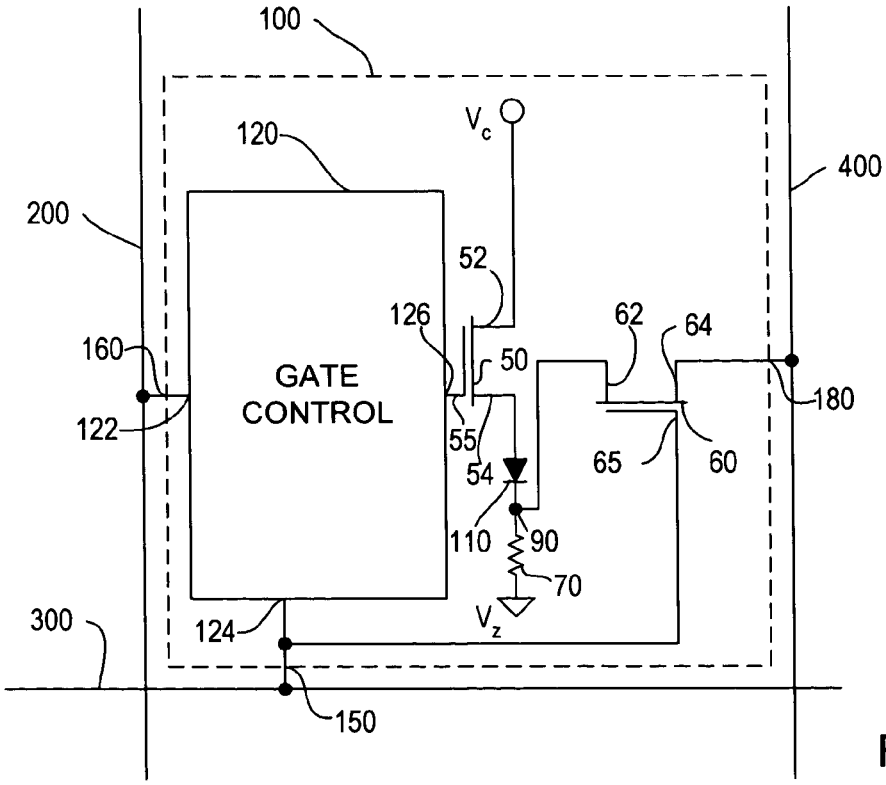

In FIGS. 5A–5C, a pixel element 100 includes a light emitting diode 110, a biasing transistor 50, a switching transistor 60, a resistor 70, and a gate control circuit 120. Gate control circuit 120 includes a gate control input 122, a gate control output 126, and a gate control enabling input 124. Gate control input 122 can receive a data signal from a data driving line 200. Gate control enabling input 124 can receive a selection signal from a selection driving line 300. Gate control output 126 is connected to a gate 55 of biasing transistor 50.

In FIGS. 5A–5C, switching transistor 60 has a gate 65, a first terminal 62, and a second terminal 64. Gate 65 is connected to a selection driving line 300, first terminal 62 of switching transistor 60 is connected to a monitoring point 90, and second terminal 64 is connected to a sensing output line 400.

In FIG. 5A, a first terminal 52 of biasing transistor 50 is connected to resistor 70 that is also connected to a common voltage $V_c$. A second terminal 54 of biasing transistor 50 is connected to light emitting diode 110 that is also connected to a common voltage $V_z$. In FIG. 5A, monitoring point 90 is between resistor 70 and first terminal 52 of biasing transistor 50.

In FIG. 5B, a first terminal 52 of biasing transistor 50 is connected to light emitting diode 110. Resistor 70 is connected between light emitting diode 110 and a common voltage $V_c$. A second terminal 54 of biasing transistor 50 is connected to a common voltage $V_z$. In FIG. 5B, monitoring point 90 is between light emitting diode 110 and resistor 70.

In FIG. 5C, a first terminal 52 of biasing transistor 50 is connected to a common voltage $V_c$. A second terminal 54 of biasing transistor 50 is connected to light emitting diode 110. Resistor 70 is connected to between light emitting diode 110 and a common voltage $V_z$. In FIG. 5C, monitoring point 90 is between light emitting diode 110 and resistor 70.

In FIGS. 5A–5C, when a selection signal (e.g., a selection voltage) from selection driving line 300 is applied to gate 65 of switching transistor 60, the sensing output 180 is enabled. Sensing output 180 can provide a direct measurement of a current $I_0$ passing through light emitting diode 110. In FIG. 5A, when sensing output 180 is enabled, the current $I_0$ passing through light emitting diode 110 can be determined from the voltage $V_m$ at sensing output 180 using the equation, $I_0=(V_c-V_m)/R$, where R is the resistance of resistor 70. In FIG. 5B, when sensing output 180 is enabled, the current $I_0$ passing through light emitting diode 110 can be determined from the voltage $V_m$ at sensing output 180 using the equation, $I_0=(V_c-V_m)/R$, where R is the resistance of resistor 70. In FIG. 5C, when sensing output 180 is enabled, the current $I_0$ passing through light emitting diode 110 can be determined from the voltage $V_m$ at sensing output 180 using the equation, $I_0=(V_m-V_z)/R$, where R is the resistance of resistor 70.

Figure 6A:
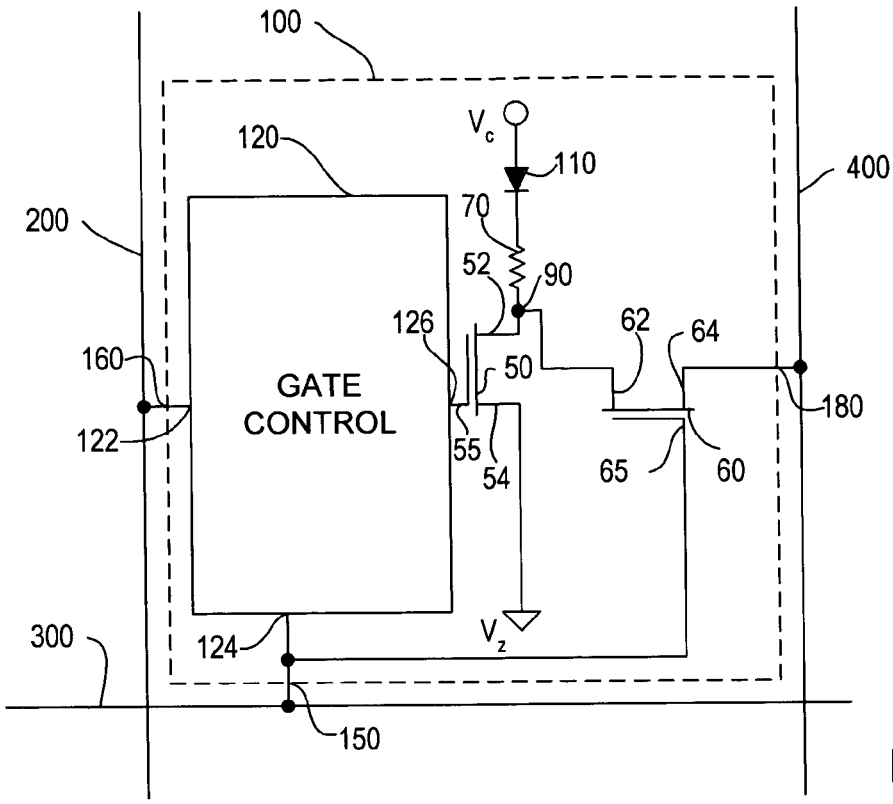
FIGS. 6A–6B are two exemplary implementations of a pixel element having a sensing output which provides a voltage output as a linear combination of the current passing through the light emitting diode and the voltage across the light emitting diode.
Figure 6B:
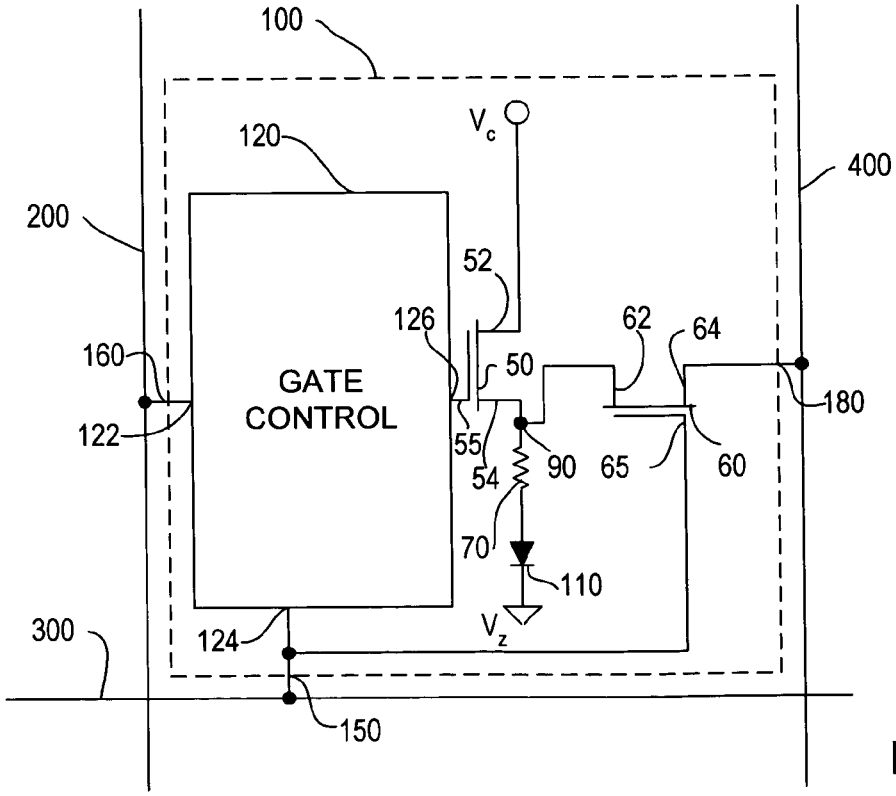

In FIG. 3 and FIGS. 5A–5C, sensing output 180 provides a sensing voltage output that can be a measurement of the current $I_0$ passing through light emitting diode 110. In FIG. 6A and FIG. 6B, sensing output 180 is designed to provide a voltage output that is a linear combination of the current $I_0$ passing through light emitting diode 110 and the voltage $V(I_0)$ across light emitting diode 110.

In FIG. 6A, a first terminal 52 of biasing transistor 50 is connected to resistor 70. Light emitting diode 110 is connected between resistor 70 and a common voltage $V_c$. A second terminal 54 of biasing transistor 50 is connected to a common voltage $V_z$. In FIG. 6A, monitoring point 90 is between resistor 70 and first terminal 52 of biasing transistor 50. When sensing output 180 is enabled, a voltage $V_m$ at sensing output 180 is related to the current $I_0$ and the voltage $V(I_0)$ with the equation, $V_m=V_c-R\ I_0-V(I_0)$.

In FIG. 6B, a first terminal 52 of biasing transistor 50 is connected to a common voltage $V_c$. A second terminal 54 of biasing transistor 50 is connected to resistor 70. Light emitting diode 110 is connected between resistor 70 and a common voltage $V_z$. In FIG. 6B, monitoring point 90 is between resistor 70 and second terminal 54 of biasing transistor 50. When sensing output 180 is enabled, a voltage $V_m$ at sensing output 180 is related to the current $I_0$ and the voltage $V(I_0)$ with the equation, $V_m=V_z+R\ I_0+V(I_0)$.

In previous implementations of pixel element 100 as shown in FIG. 2B, FIG. 3, FIGS. 5A–5C, FIG. 6A, and FIG. 6B, switching transistor 60 provides an exemplary implementation of a sensing control circuit.

Figure 7A:
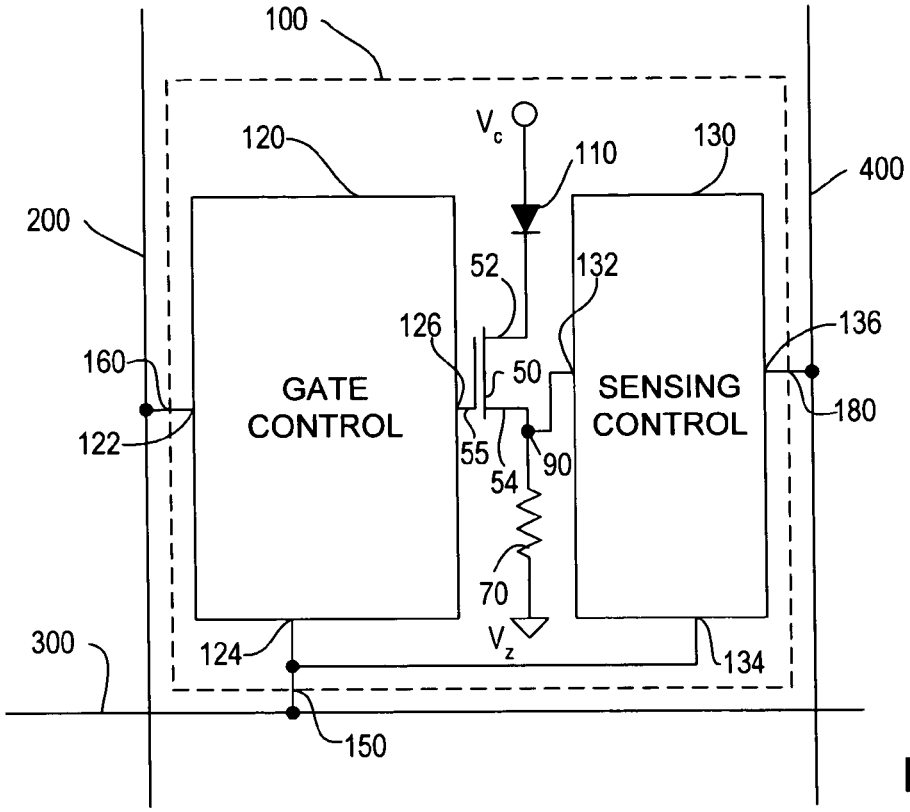
FIG. 7A shows a generic implementation of pixel element that includes a sensing control circuit.

FIG. 7A shows a generic implementation of pixel element 100 that includes a sensing control circuit. In FIG. 7A, a pixel element 100 includes a light emitting diode 110, a biasing transistor 50, a resistor 70, a gate control circuit 120, and a sensing control circuit 130. Gate control circuit 120 includes a gate control input 122, a gate control output 126, and a gate control enabling input 124. Gate control input 122 can receive a data signal from a data driving line 200. Gate control enabling input 124 can receive a selection signal from a selection driving line 300. Gate control output 126 is connected to a gate 55 of biasing transistor 50.

A first terminal 52 of biasing transistor 50 is connected to light emitting diode 110. A second terminal 54 of biasing transistor 50 is connected to resistor 70. Resistor 70 is connected to a common voltage $V_z$. In addition to connecting to first terminal 52 of biasing transistor 50, light emitting diode 110 is connected a common voltage $V_c$.

Sensing control circuit 130 includes an input 132, an output 136, and enabling input 134. Enabling input 134 sensing control circuit 130 is connected to a selection driving line 300, input 132 of sensing control circuit 130 is connected to a monitoring point 90, and output 136 of sensing control circuit 130 is connected to a sensing output line 400. In FIG. 7A, monitoring point 90 is between resistor 70 and second terminal 54 of biasing transistor 50.

A sensing control circuit generally is operable to enable and disable sensing output 180 of pixel element 100 with a selection signal received from selection input 150 of pixel element 100. When sensing output 180 is enabled, the sensing control circuit is configured such that sensing output 180 of pixel element 100 receives a sensing signal from monitoring point 90. When sensing output 180 is disabled, the sensing control circuit is configured such that sensing output 180 of pixel element 100 receives substantially no sensing signals from monitoring point 90. People skilled in the art can find verity of implementations of sensing control circuits that can be used in pixel element 100. In general, sensing control circuit 130 can include additional transistors, capacitors, or resistors in additional to switching transistor 60. Sensing control circuit 130 can also include additional signal inputs, signal outputs, or enabling inputs.

Figure 7B:
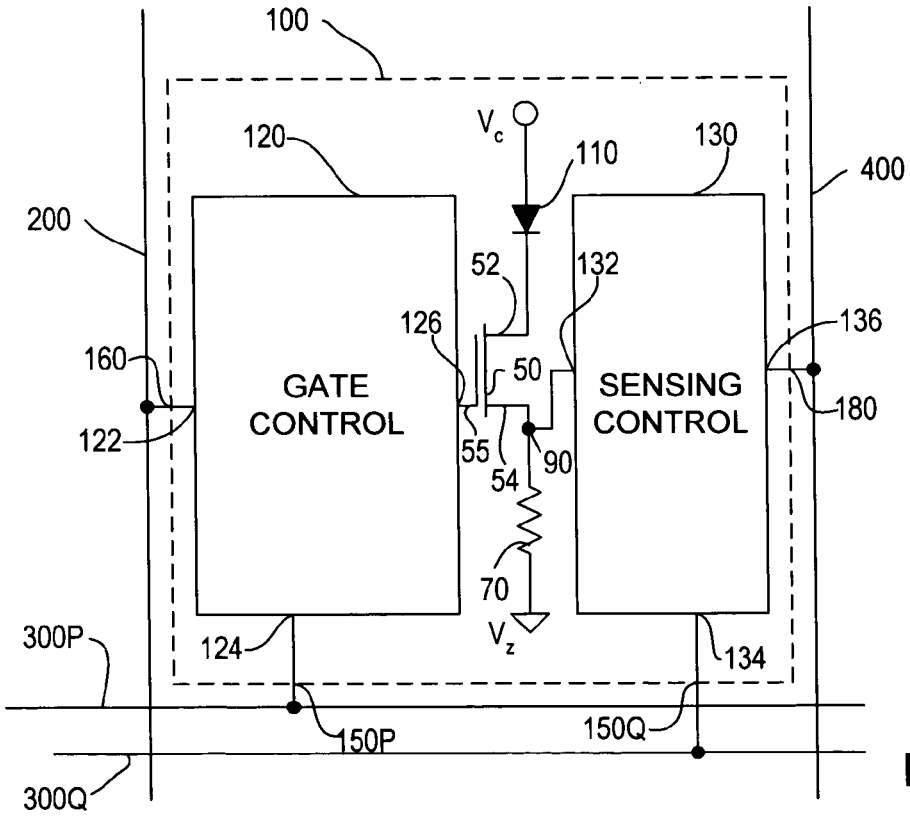
FIG. 7B shows a pixel element that includes two selection inputs.

In FIG. 7A, gate control circuit 120 and sensing control circuit 130 in pixel element 100 receive selection signals from the same selection driving line 300. In another implementation, as shown in FIG. 7B, gate control circuit 120 and sensing control circuit 130 in pixel element 100 receive selection signals from different selection driving lines. Gate control circuit 120 can receive a selection signal from a selection driving line 300P, and sensing control circuit 130 can receive a selection signal from a selection driving line 300Q. Pixel element 100 can include two selection inputs, a selection input 150P, and a selection input 150Q. Selection input 150P is configured to receive a selection signal from a selection driving line 300P. Selection input 150Q is configured to receive a selection signal from a selection driving line 300Q.

In addition, people skilled in the art can design a gate control circuit 120 that is enabled and disabled with signals received from two or more selection driving lines. People skilled in the art can also design a sensing control circuit 130 that is enabled and disabled with signals received from two or more selection driving lines.

In the implementations disclosed herein, biasing transistor 50 can be an NFET or a PFET. In some implementations, first terminal 52 is the source of biasing transistor 50, and second terminal 54 is the drain of biasing transistor 50. In some implementations, first terminal 52 is the drain of biasing transistor 50, and second terminal 54 is the source of biasing transistor 50.

As a specific example, in FIG. 3, the common voltage $V_c$ can be selected to be larger than the common voltage $V_z$. In one implementation, biasing transistor 50 is an NFET, first terminal 52 is the drain of biasing transistor 50, and second terminal 54 is the source of biasing transistor 50. Alternatively, in another implementation, biasing transistor 50 is a PFET, first terminal 52 is the source of biasing transistor 50, and second terminal 54 is the drain of biasing transistor 50.

In the implementations disclosed herein, switching transistor 40 can be an NFET or a PFET. In some implementations, first terminal 42 is the source of switching transistor 40, and second terminal 44 is the drain of switching transistor 40. In some implementations, first terminal 42 is the drain of switching transistor 40, and second terminal 44 is the source of switching transistor 40.

In the implementations disclosed herein, switching transistor 60 can be an NFET or a PFET. In some implementations, first terminal 62 is the source of switching transistor 60, and second terminal 64 is the drain of switching transistor 60. In some implementations, first terminal 62 is the drain of switching transistor 60, and second terminal 64 is the source of switching transistor 60.

In the implementations disclosed herein, light emitting diode 110 can be an organic light emitting diode, electron luminance diode, light emitting diode with a pn junction, light emitting diode without a pn junction, or other kinds of light emitting diode.

B. Active Matrix Display Having Sensing Output Lines

Figure 7C:
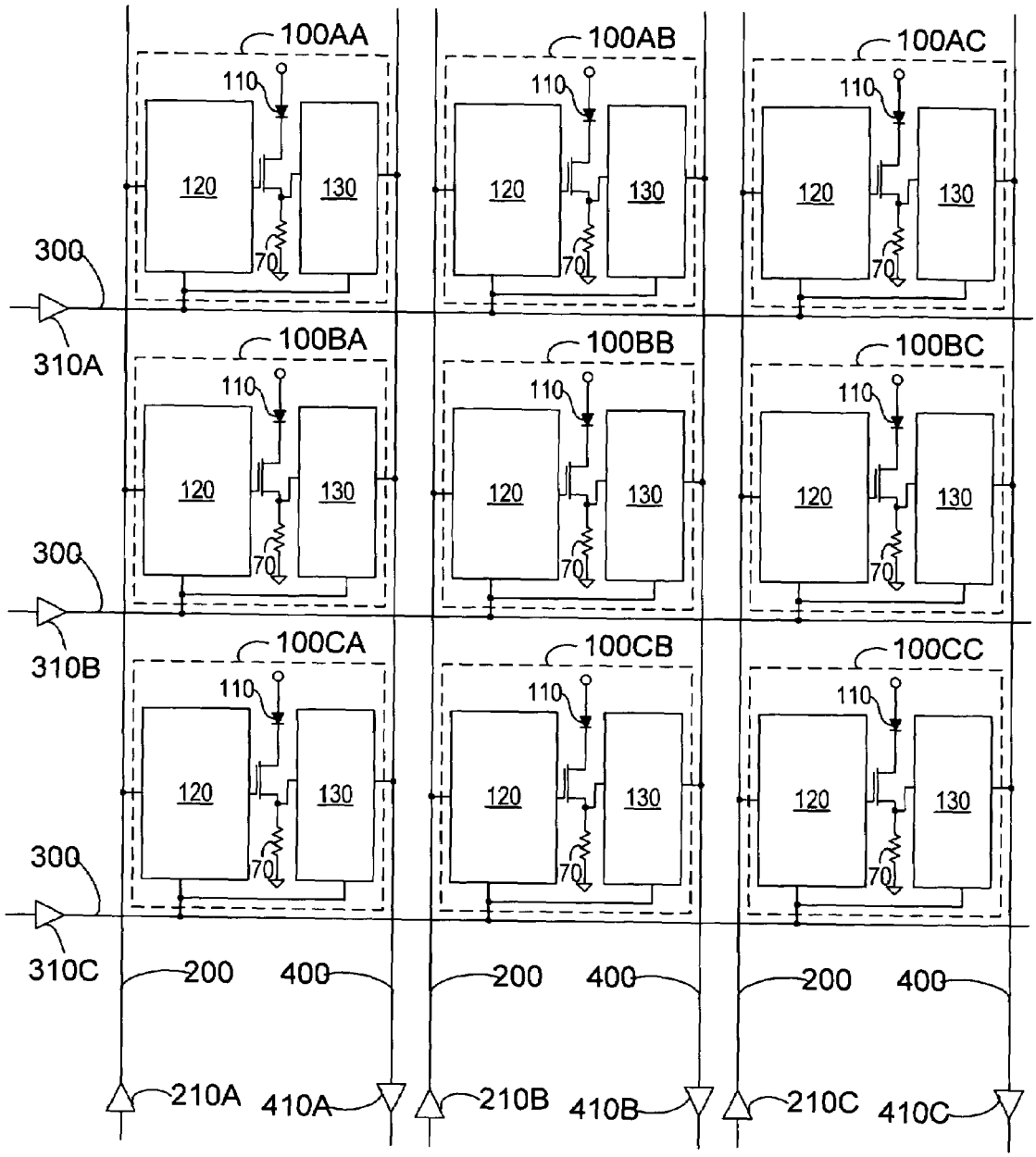
FIG. 7C shows an active matrix display having sensing output lines connected to sensing detectors.
Figure 7D:
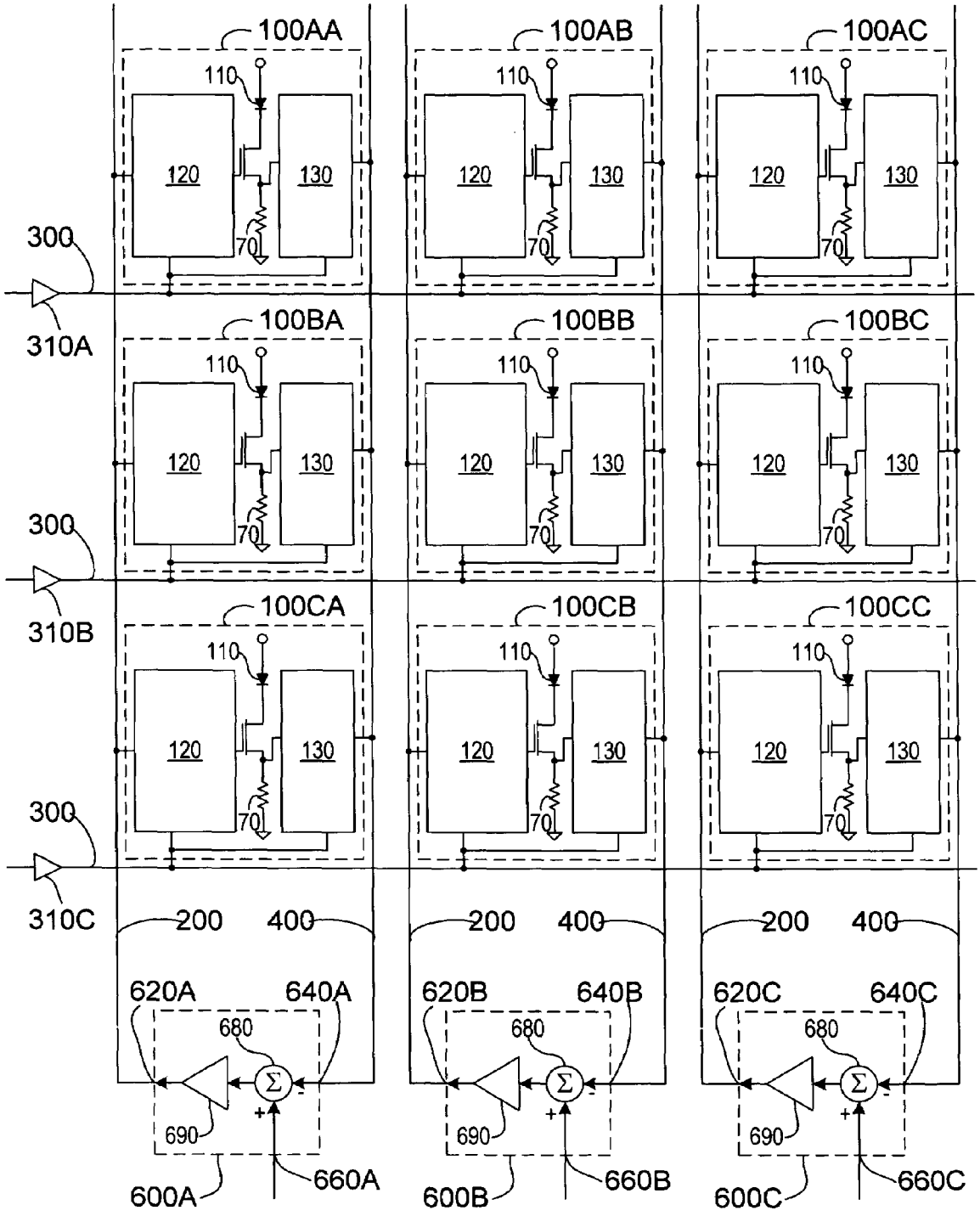
FIG. 7D shows an active matrix display having data driving lines and sensing output lines connected to feedback data drivers.

FIG. 7C shows an active matrix display having sensing output lines connected to sensing detectors. FIG. 7D shows an active matrix display having data driving lines and sensing output lines connected to feedback data drivers. The active matrix display in FIG. 7C or FIG. 7D includes a matrix of pixel elements, an array of selection driving line, an array of data driving lines, and an array of sensing output lines. The array of data driving lines is essentially perpendicular to the array of selection driving lines. The array of sensing output lines is essentially in parallel with the array of data driving lines. A pixel element 100 generally is connected to a selection driving line 300, a data driving line 200, and a sensing output line 400.

In one implementation, the active matrix displays in FIG. 7C and FIG. 7D are based on pixel element 100 as shown FIG. 7A. Pixel element 100 generally includes a light emitting diode 110, a biasing transistor 50, a resistor 70, a gate control circuit 120, and a sensing control circuit 130. Pixel element 100 also includes a selection input 150, a data input 160, and a sensing output 180. Selection input 150 can receive a selection signal from selection driving line 300. Data input 160 can receive a data signal from data driving line 200. A data signal generally can change a gate voltage at gate 55 of biasing transistor 50 when pixel element 100 is selected with a selection signal received at selection input 150. Sensing output 180 generally can output a sensing signal when sensing output 180 is enabled with a selection signal received at selection input 150.

In FIG. 7C, a selection driving line 300 generally is connected to a selection driver (e.g., 310A, 310B, or 310C). A data driving line 200 generally is connected to a data driver (e.g., 210A, 210B, or 210C). A sensing output line 400 generally is connected to a sensing detector (e.g., 410A, 410B, or 410C).

In FIG. 7D, a selection driving line 300 generally is connected to a selection driver (e.g., 310A, 310B, or 310C). Data driving lines 200 and sensing output lines 400 are generally connected to feedback data drivers (e.g., 600A, 600B, or 600C).

Feedback data driver 600A includes a data output 620A, a sensing input 640A, and a target input 660A. Feedback data driver 600B includes a data output 620B, a sensing input 640B, and a target input 660B. Feedback data driver 600C includes a data output 620C, a sensing input 640C, and a target input 660C.

A data driving line 200 generally is connected to a data output of a feedback data driver (e.g., 620A, 620B, or 620C). A sensing output line 400 generally is connected a sensing input of a feedback data driver (e.g., 640A, 640B, or 640C).

In the implementations disclosed herein, the array of data driving lines can be essentially perpendicular to the array of selection driving lines. The array of data driving lines can also generally cross the array of selection driving lines. The array of sensing output lines can be essentially in parallel with the array of data driving lines. The array of sensing output lines can also be in other geometric relationship with the array of data driving lines. The array of sensing output lines can generally cross the array of selection driving lines.

In additional to pixel element 100 as shown in FIG. 7A, other implementations of pixel element 100 can also be used in the active matrix displays as shown in FIG. 7C and FIG. 7D. For example, implementations of pixel element 100 as shown in FIG. 3, FIGS. 5A–5C, and FIGS. 6A–6B all can be used in the active matrix displays as shown in FIG. 7C and FIG. 7D. People skilled in the art can find additional implementations of pixel element 100 that can be used in the active matrix displays as shown in FIG. 7C and FIG. 7D.

In general, a pixel element 100 that can be used in the active matrix displays as shown in FIG. 7C and FIG. 7D includes (1) a light emitting diode 110, (2) a resistor 70, (3) a monitoring point 90 on a current path that passes through at least light emitting diode 110 and resistor 70, (4) a biasing transistor 50 and (5) a sensing output 180 that can receive a sensing signal from monitoring point 90.

In the implementations of pixel element 100 as show in FIG. 3, FIGS. 5A–5C, FIGS. 6A–6B, and FIGS. 7A–7B, the total current passing through light emitting diode 110 is essentially the same as the total current passing through resistor 70; the monitoring point is on a current path that passes through at least each of following electrical elements: (1) light emitting diode 110, (2) the semiconductor channel of biasing transistor 50, and (3) resistor 70 (not necessarily in the order as listed). In other implementations of pixel element 100, the total current passing through light emitting diode 110 can be different from the total current passing through resistor 70. Pixel element 100 can include one or more additional resistors other than resistor 70, and monitoring point 90 can be on a current path that passes through at least light emitting diode 110 and one of the additional resistors other than resistor 70. In some more implementations, monitoring point 90 can be on a current path that passes through light emitting diode 110, resistor 70, and one or more other electrical components.

C. Measuring Individual Pixel Element in Active Matrix Display

Figure 8:
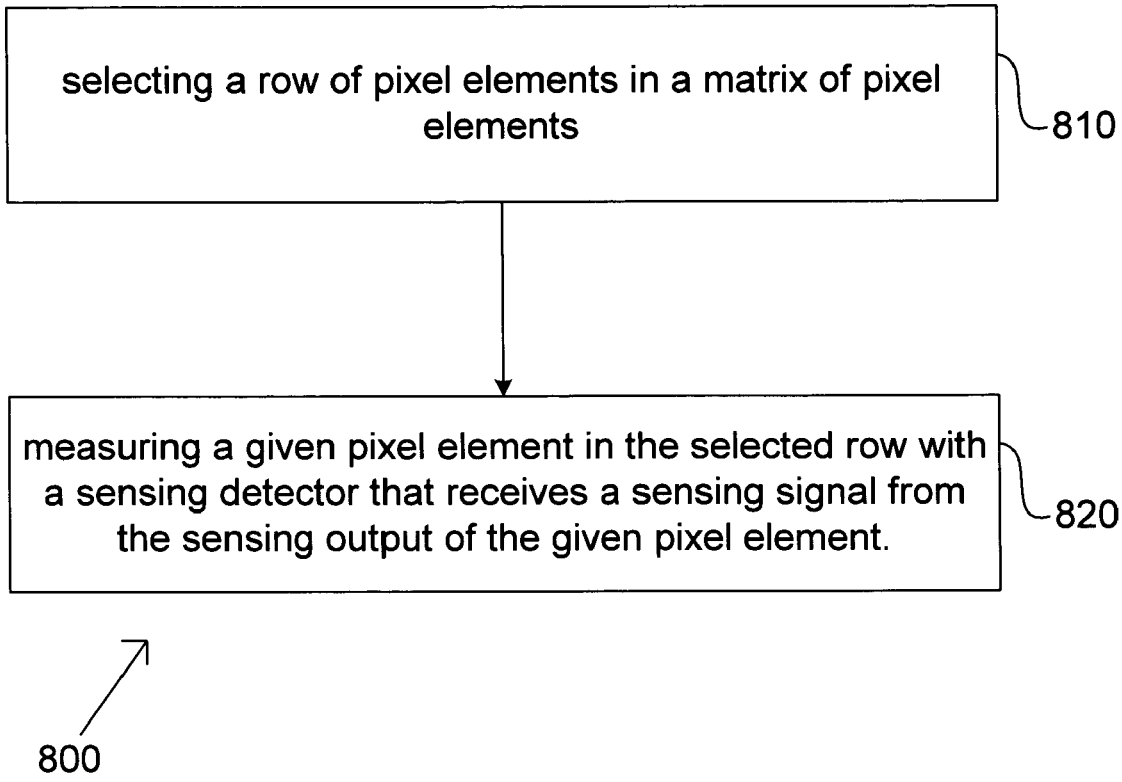
FIG. 8 shows a method of measuring the property of an individual pixel element in an active matrix display.

FIG. 8 shows a method 800 for measuring the property of an individual pixel element in an active matrix display. Method 800 for measuring the property of an individual pixel element in an active matrix display generally includes blocks 810 and 820.

Block 810 includes selecting a row of pixel elements in a matrix of pixel elements. In one implementation, selecting a row of pixel elements includes applying a selection signal to a selection driving line that electrically connects to the selection inputs of the pixel elements in the selected row to enable the data inputs and the sensing outputs of the pixel elements in the selected row. For example, when method 800 is applied to the active matrix display as shown in FIG. 7C, a selection driver 310B can output a selection signal to a selection driving line and enables a row of pixel elements that include pixel elements 100BA, 100BB, and 100BC.

In some other implementations, a pixel element can include a first selection input and a second selection input. FIG. 7B provides an exemplary implementation of a pixel element that includes two selection inputs. Selecting a row of pixel elements includes applying a first selection signal to a selection driving line that electrically connects to the first selection inputs of the pixel elements in the selected row to enable the data inputs of the pixel elements in the selected row. Selecting a row of pixel elements also includes applying a second selection signal to a selection driving line that electrically connects to the second selection inputs of the pixel elements in the selected row to enable the sensing outputs of the pixel elements in the selected row.

Block 820 includes measuring a given pixel element in the selected row with a sensing detector that receives a sensing signal from the sensing output of the given pixel element. The sensing signal is generally related to a current flowing through at least the light emitting diode and the resistor in the given pixel element.

In one implementation, as shown in FIG. 7C, the sensing signal of a pixel element is a voltage signal $V_m$ received from a monitoring point on a current path that passes through both a light emitting diode and a resistor. When a row of pixel elements connecting to selection driver 310B is selected, sensing detectors 410A, 410B, and 410C are respectively used to receive sensing signals from pixel elements 100BA, 100BB, and 100BC. When pixel element 100 in FIG. 7A is used in the active matrix display of FIG. 7C, the sensing signal $V_m$ is related to the current $I_0$ passing through light emitting diode 110 with the equation, $V_m=I_0 R+V_z$, where R is the resistance of resistor 70, and $V_z$ is a common voltage.

D. Driving Pixel Element in Negative Feedback Loop

Figure 9:
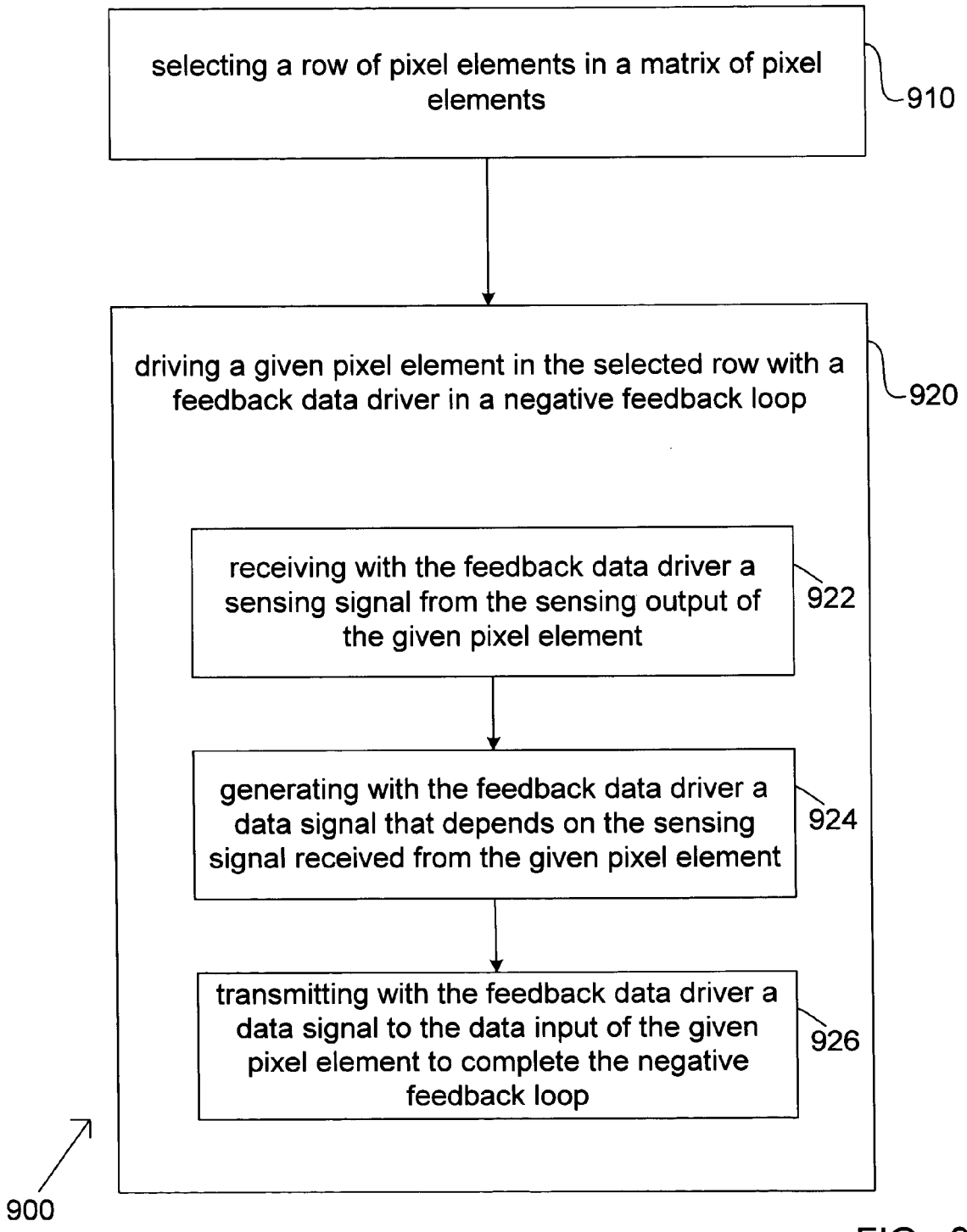
FIG. 9 shows a method for driving pixel elements in an active matrix display.

FIG. 9 shows a method 900 for driving pixel elements in an active matrix display. Method 900 for driving pixel elements in an active matrix display generally includes blocks 910 and 920.

Block 910 includes selecting a row of pixel elements in a matrix of pixel elements. In one implementation, selecting a row of pixel elements includes applying a selection signal to a selection driving line that electrically connects to the selection inputs of the pixel elements in the selected row to enable the data inputs and the sensing outputs of the pixel elements in the selected row. For example, when method 900 is applied to the active matrix display as shown in FIG. 7D, a selection driver 310B can output a selection signal to a selection driving line and enables a row of pixel elements that include pixel elements 100BA, 100BB, and 100BC.

In some other implementations, a pixel element can include a first selection input and a second selection input. FIG. 7B provides an exemplary implementation of a pixel element that includes two selection inputs. Selecting a row of pixel elements includes applying a first selection signal to a selection driving line that electrically connects to the first selection inputs of the pixel elements in the selected row to enable the data inputs of the pixel elements in the selected row. Selecting a row of pixel elements also includes applying a second selection signal to a selection driving line that electrically connects to the second selection inputs of the pixel elements in the selected row to enable the sensing outputs of the pixel elements in the selected row.

Block 920 includes driving a given pixel element in the selected row with a feedback data driver in a negative feedback loop. Block 920 generally includes blocks 922, 924, and 926. Block 922 includes receiving with the feedback data driver a sensing signal from the sensing output of the given pixel element. The sensing signal is related to a current flowing through both the light emitting diode and the resistor in the given pixel element. Block 924 includes generating with the feedback data driver a data signal that depends on the sensing signal received from the given pixel element. Block 926 includes transmitting with the feedback data driver a data signal to the data input of the given pixel element to complete the negative feedback loop.

When a given pixel element in the selected row is driven with a feedback data driver in a negative feedback loop, the negative feedback loop can be a proportional control loop, a proportional-integration control loop, or a proportional-integration-derivative control loop. The negative feedback loop can be an analog control loop or a digital control loop.

In one implementation, block 924 includes the following: (1) comparing a reference signal with a corresponding signal that depends on the sensing signal received from the given pixel element; (2) generating an error signal that depends on the difference between the reference signal and the corresponding signal; and (3) generating a data signal that depends on the error signal. The corresponding signal can be proportional to the sensing signal received from the given pixel element. The error signal can be proportional to a difference between the reference signal and the corresponding signal. The data signal can be proportional to the error signal.

People skilled in the art generally can implement blocks 922, 924, and 926 with hardware components, software programs, or firmware programs. People skilled in the art generally can also implement blocks 922, 924, and 926 with some combinations of hardware components, software programs, and firmware programs.

In addition, people skilled in the art generally can implement block 920 in other ways based on hardware components, software programs, and firmware programs.

In one implementation, as shown in FIG. 7D, when a row of pixel elements connecting to selection driver 310B is selected, feedback data drivers 600A, 600B, and 600C are respectively used to driver pixel elements 100BA, 100BB, and 100BC in a negative feedback loop.

Feedback data driver 600A includes a data output 620A, a sensing input 640A, and a target input 660A. Feedback data driver 600B includes a data output 620B, a sensing input 640B, and a target input 660B. Feedback data driver 600C includes a data output 620C, a sensing input 640C, and a target input 660C.

As an example, a data signal at output 620A of feedback data driver 600A generally depends on the difference between a sensing signal received at sensing input 640A and a target signal. The target signal is related to a signal received at target input 660A. The target signal can be equal to a signal received at target input 660A. The target signal can be proportional to a signal received at target input 660A. The target signal can be generally depend on a signal received at target input 660A in some other predetermined ways.

In one implementation, the data signal at output 620A increases if the sensing signal received at sensing input 640A is smaller than the target signal, and the data signal at output 620A decreases if the sensing signal received at sensing input 640A is larger than the target signal. This implementation generally can be applied to a pixel element which is designed in such a way that a sensing signal at the sensing output of the pixel element increases if a current passing through a light emitting diode in the pixel element increases.

In another implementation, the data signal at output 620A increases if the sensing signal received at sensing input 640A is larger than the target signal, and the data signal at output 620A decreases if the sensing signal received at sensing input 640A is smaller than the target signal. This implementation generally can be applied to a pixel element which is designed in such a way that a sensing signal at the sensing output of the pixel element decreases if a current passing through a light emitting diode in the pixel element increases.

In one implementation, feedback data driver 600A includes a summation node 680 and a controller 690. Summation node 680 receives a corresponding signal and a reference signal. The corresponding signal depends on the sensing signal received at sensing input 640A. The reference signal depends on a signal received at target input 660A. Summation node 680 generates an error signal. The error signal generally can depend on a difference between the corresponding signal received by summation node 680 and the reference signal received by summation node 680. Controller 690 receives the error signal from summation node 680 and generates a data signal at output 620A. The data signal generated at output 620A can generally depend on the error signal.

People skilled in the art generally can design variety of implementations of the feedback data driver that enable a pixel element be driven in a negative feedback loop.

The present invention has been described in terms of a number of implementations. The invention, however, is not limited to the implementations depicted and described. Rather, the scope of the invention is defined by the appended claims. In the appended claims, when an element A is electrically connected to an element B, generally, the element A can be physically connected to the element B directly, or the element A can be physically connected to the element B through one or more intermediate elements. Any element in a claim that does not explicitly state "means for" performing a specific function, or "step for" performing a specific function, is not to be interpreted as a "means" or "step" clause as specified in 35 U.S.C. §112, ¶6.

What is claimed is:

1. An active matrix display comprising:

an array of selection driving lines;

an array of data driving lines crossing the array of selection driving lines;

an array of sensing output lines crossing the array of selection driving lines; and a matrix of pixel elements, wherein a pixel element electrically connects to at least one selection driving line and electrically connects to at least one data driving line, the pixel element comprises, a biasing transistor having a gate, a source, and a drain, and a semiconductor channel between the source thereof and the drain thereof, a light emitting diode electrically connecting to the semiconductor channel of the biasing transistor, a resistor electrically connecting to the light emitting diode, a monitoring point on a current path that passes through at least the light emitting diode and the resistor, and a sensing output electrically connecting to a sensing output line, the sensing output receiving a sensing signal from the monitoring point when the sensing output is enabled.

2. The active matrix display of claim 1, wherein the light emitting diode comprises an organic light emitting diode.

3. The active matrix display of claim 1, wherein the light emitting diode connects to the semiconductor channel of the biasing transistor through the source of the biasing transistor.

4. The active matrix display of claim 1, wherein the light emitting diode connects to the semiconductor channel of the biasing transistor through the drain of the biasing transistor.

5. The active matrix display of claim 1, wherein the resistor comprises a first terminal and a second terminal, the monitoring point electrically connects to the first terminal of the resistor, and the second terminal of the resistor electrically connects to a common voltage.

6. The active matrix display of claim 5, wherein the light emitting diode comprises a first terminal and a second terminal, the first terminal of the light emitting diode electrically connects to the first terminal of the resistor through the semiconductor channel of the biasing transistor.

7. The active matrix display of claim 5, wherein the light emitting diode comprises a first terminal and a second terminal, the first terminal of the light emitting diode connects to the first terminal of the resistor directly.

8. The active matrix display of claim 1, wherein the resistor serially connects to the light emitting diode and forms a compound component having a first terminal and a second terminal, the monitoring point electrically connects to the first terminal of the compound component, the second terminal of the compound component electrically connects to a common voltage.

9. The active matrix display of claim 1, wherein the pixel element further comprises:

a sensing control circuit operable to enable and disable the sensing output of the pixel element with a selection signal.

10. The active matrix display of claim 9, wherein the sensing control circuit receives the selection signal from a selection driving line.

11. The active matrix display of claim 9, wherein the sensing control circuit is configured such that the sensing output receives substantially no sensing signals from the monitoring point when the sensing output of the pixel element is disabled.

12. The active matrix display of claim 9, wherein the sensing control circuit comprises:

a switching transistor having a gate, a source, and a drain, and a semiconductor channel between the source thereof and the drain thereof, the gate of the switching transistor operable to be controlled with the selection signal; and wherein the monitoring point electrically connects to the sensing output through the semiconductor channel of the switching transistor.

13. The active matrix display of claim 1, wherein the pixel element further comprises:

means for controlling the sensing output of the pixel element such that the sensing output receiving a sensing signal from the monitoring point when the sensing output is enabled.

14. The active matrix display of claim 13, wherein the means for controlling the sensing output is configured such that the sensing output receives substantially no sensing signals from the monitoring point when the sensing output of the pixel element is disabled.

15. The active matrix display of claim 13, wherein the means for controlling the sensing output is configured to receive a selection signal from a selection driving line.

16. The active matrix display of claim 15, wherein the means for controlling the sensing output comprises:

a switching transistor having a gate, a source, and a drain, and a semiconductor channel between the source thereof and the drain thereof, the gate of the switching transistor being controlled with the selection signal; and wherein the monitoring point electrically connects to the sensing output through the semiconductor channel of the switching transistor.

17. The active matrix display of claim 1, wherein the pixel element further comprises:

a gate control circuit comprising a gate control output and a gate control input, the gate control output electrically connecting to the gate of the biasing transistor, the gate control input receiving a data signal from a data driving line, wherein the data signal on the data input is operable to change a voltage on the gate of the biasing transistor when the gate control input is enabled with a selection signal.

18. The active matrix display of claim 17, wherein the gate control circuit receives the selection signal from a selection driving line.

19. The active matrix display of claim 17, wherein the voltage on the gate of the biasing transistor is substantially maintained when the data input is disabled.

20. The active matrix display of claim 1, wherein the pixel element further comprises:

means for controlling the gate of the biasing transistor such that a data signal received from a data driving line is operable to change a voltage on the gate of the biasing transistor when a gate control input is enabled.

21. The active matrix display of claim 20, wherein the means for controlling the gate is configured to maintain substantially the voltage on the gate of the biasing transistor when a gate control input is disabled.

22. The active matrix display of claim 1, further comprising:

a plurality of selection drivers, and wherein a selection driver electrically connects to a selection driving line, the selection driving line electrically connects a row of pixel elements in the matrix of pixel elements, the row of pixel elements are configured to be selected using one or more selection drivers.

23. The active matrix display of claim 1, further comprising:

a plurality of feedback data drivers, wherein a feedback data driver electrically connects to a data driving line and a sensing output line, the data driving line and the sensing output line connect to a column of pixel elements, the feedback data driver detects a sensing signal on the sensing output line and outputs a data signal on the data driving line, and when a given pixel element is selected from the column of pixel elements, the feedback data driver is operable to drive the given pixel element in a negative feedback loop.

24. The active matrix display of claim 23, wherein the feedback data driver is operable to drive the given pixel element in a negative feedback loop that is selected from a group consisting of a proportional control loop, a proportional-integration control loop, and a proportional-integration-derivative control loop.

25. The active matrix display of claim 23, wherein the feedback data driver is operable to drive the given pixel element in a negative feedback loop that is selected from a group consisting of an analog control loop and a digital control loop.

26. The active matrix display of claim 23, wherein a feedback data driver comprises:

a summation node; and a controller receiving an error signal from the summation node.

27. The active matrix display of claim 1, further comprising:

means for selecting a row of pixel elements.

28. The active matrix display of claim 1, further comprising:

means for driving a given pixel element in a selected row in a negative feedback loop.

29. An active matrix display comprising:

an array of selection driving lines;

an array of data driving lines crossing the array of selection driving lines;

an array of sensing output lines crossing the array of selection driving lines; and a matrix of pixel elements, wherein a pixel element electrically connects to at least one selection driving line, the pixel element comprises, a light emitting diode, a resistor electrically connecting to the light emitting diode, a data input electrically connecting to a data driving line, the data input receiving a data signal that changes a current flowing through the light emitting diode when the data input is enabled, and a sensing output electrically connecting to a sensing output line, the sensing output generating a sensing signal when the sensing output is enabled, the sensing output generating substantially no sensing signal when the sensing output is disabled, and wherein a change in a current flowing through both the light emitting diode and the resistor induces a change in the sensing signal.

30. The active matrix display of claim 29, wherein the sensing output of the pixel element is configured to be enabled with a select signal received from a selection driving line.

31. The active matrix display of claim 29, wherein the pixel element further comprises:

a selection input electrically connecting to a selection driving line, wherein a select signal received on the selection input enables both the data input and the sensing output.

32. The active matrix display of claim 31, wherein a deselect signal received on the selection input disables both the data input and the sensing output.

33. The active matrix display of claim 29, wherein the pixel element further comprises:

a first selection input electrically connecting to a first selection driving line, wherein a select signal received on the first selection input enables the data input, a second selection input electrically connecting to a second selection driving line, wherein a select signal received on the second selection input enables the sensing output.

34. The active matrix display of claim 33, wherein a deselect signal received on the first selection input disables the data input and a deselect signal received on the second selection input disables the sensing output.

35. The active matrix display of claim 29, wherein the pixel element further comprises:

a biasing transistor having a gate, a source, and a drain, and a semiconductor channel between the source thereof and the drain thereof; and wherein the light emitting diode electrically connects to the semiconductor channel of the biasing transistor.

36. The active matrix display of claim 35, wherein the light emitting diode connects to the semiconductor channel of the biasing transistor through the source of the biasing transistor.

37. The active matrix display of claim 35, wherein the light emitting diode connects to the semiconductor channel of the biasing transistor through the drain of the biasing transistor.

38. The active matrix display of claim 35, wherein the pixel element further comprises:

a gate control circuit comprising a gate control output and a gate control input, the gate control output electrically connecting to the gate of the biasing transistor, the gate control input receiving a data signal from the data input of the pixel element, wherein the data signal received from the data input of the pixel element is operable to change a voltage on the gate of the biasing transistor when the gate control input is enabled.

39. The active matrix display of claim 38, wherein the gate control circuit receives a selection signal from a selection driving line.

40. The active matrix display of claim 38, wherein the voltage on the gate of the biasing transistor is substantially maintained when the gate control input is disabled.

41. The active matrix display of claim 38, wherein the gate control circuit comprise:

a first switching transistor having a gate, a source, and a drain, and a semiconductor channel between the source thereof and the drain thereof, the gate of the first switching transistor being controlled with the selection signal;

a storage capacitor electrically connecting to the gate control output; and wherein the gate control output electrically connects to the gate control input through the semiconductor channel of the first switching transistor.

42. The active matrix display of claim 35, wherein the pixel element further comprises:

means for controlling the gate of the biasing transistor such that a data signal received on the data input of the pixel element is operable to change a voltage on the gate of the biasing transistor when the data input of the pixel element is enabled.

43. The active matrix display of claim 42, wherein the means for controlling the gate receives a selection signal from a selection driving line.

44. The active matrix display of claim 42, wherein the means for controlling the gate is configured to maintain substantially the voltage on the gate of the biasing transistor when the data input of the pixel element is disabled.

45. The active matrix display of claim 43, wherein the means for controlling the gate comprises:

a first switching transistor having a gate, a source, and a drain, and a semiconductor channel between the source thereof and the drain thereof, the gate of the first switching transistor being controlled with the selection signal;

a storage capacitor electrically connecting to the gate control output; and wherein the gate control output electrically connects to the data input of the pixel element through the semiconductor channel of the first switching transistor.

46. The active matrix display of claim 29, wherein the pixel element further comprises:

a sensing control circuit operable to enable and disable the sensing output of the pixel element with a selection signal.

47. The active matrix display of claim 46, wherein the sensing control circuit receives the selection signal from a selection driving line.

48. The active matrix display of claim 46, wherein a change in a current flowing through both the light emitting diode and the resistor induces substantially no change in a signal at the sensing output of the pixel element when the sensing output of the pixel element is disabled with the sensing control circuit.

49. The active matrix display of claim 46, wherein the sensing control circuit comprise:

a second switching transistor having a gate, a source, and a drain, and a semiconductor channel between the source thereof and the drain thereof, the gate of the second switching transistor being controlled with the selection signal; and wherein the sensing output of the pixel element generates a sensing signal that is received from the semiconductor channel of the second switching transistor when the selection signal is received on the gate of the second switching transistor.

50. The active matrix display of claim 29, wherein the pixel element further comprises:

means for controlling the sensing output of the pixel element such that the sensing output generates a sensing signal when the sensing output of the pixel element is enabled.

51. The active matrix display of claim 50, wherein the means for controlling the sensing output of the pixel element is configured to receive a selection signal from a selection driving line.

52. The active matrix display of claim 50, wherein the means for controlling the sensing output is configured such that a change in a current flowing through both the light emitting diode and the resistor induces substantially no change in a signal at the sensing output of the pixel element when the sensing output of the pixel element is disabled.

53. The active matrix display of claim 51, wherein the means for controlling the sensing output comprises:

a second switching transistor having a gate, a source, and a drain, and a semiconductor channel between the source thereof and the drain thereof, the gate of the second switching transistor being controlled with the selection signal; and wherein the sensing output of the pixel element generates a sensing signal that is received from the semiconductor channel of the second switching transistor when the selection signal is received on the gate of the second switching transistor.

54. The active matrix display of claim 35, wherein the sensing signal is a function of the current flowing through the light emitting diode.

55. The active matrix display of claim 54, wherein the sensing signal is proportional to the current flowing through the light emitting diode.

56. The active matrix display of claim 35, wherein the sensing signal is a function of the current flowing through the light emitting diode and the voltage across the light emitting diode.

57. The active matrix display of claim 56, wherein the sensing signal is proportional to a linear combination of the current flowing through the light emitting diode and the voltage across the light emitting diode.

58. The active matrix display of claim 35, wherein the pixel element further comprises:

a monitoring point on a current path that passes through at least the light emitting diode and the resistor, the sensing output of the pixel element receiving the sensing signal from the monitoring point when the sensing output of the pixel element is enabled.

59. The active matrix display of claim 58, wherein the resistor comprises a first terminal and a second terminal, the monitoring point electrically connects to the first terminal of the resistor, and the second terminal of the resistor electrically connects to a common voltage.

60. The active matrix display of claim 59, wherein the light emitting diode comprises a first terminal and a second terminal, the first terminal of the light emitting diode connects to the first terminal of the resistor through the semiconductor channel of the biasing transistor.

61. The active matrix display of claim 59, wherein the light emitting diode comprises a first terminal and a second terminal, the first terminal of the light emitting diode connects to the first terminal of the resistor directly.

62. The active matrix display of claim 58, wherein the resistor serially connects to the light emitting diode and forms a compound component having a first terminal and a second terminal, the monitoring point electrically connects to the first terminal of the compound component, the second terminal of the compound component electrically connects to a common voltage.

63. The active matrix display of claim 29, further comprising:

a plurality of selection drivers, and wherein a selection driver electrically connects to a selection driving line, the selection driving line electrically connects a row of pixel elements in the matrix of pixel elements, the row of pixel elements are configured to be selected using one or more selection drivers.

64. The active matrix display of claim 29, further comprising:

a plurality of feedback data drivers, wherein a feedback data driver electrically connects to a data driving line and a sensing output line, the data driving line and the sensing output line connect to a column of pixel elements, the feedback data driver detects a sensing signal on the sensing output line and outputs a data signal on the data driving line, and when a given pixel element is selected from the column of pixel elements, the feedback data driver is operable to drive the given pixel element in a negative feedback loop.

65. The active matrix display of claim 64, wherein the feedback data driver is operable to drive the given pixel element in a negative feedback loop that is selected from a group consisting of a proportional control loop, a proportional-integration control loop, and a proportional-integration-derivative control loop.

66. The active matrix display of claim 64, wherein the feedback data driver is operable to drive the given pixel element in a negative feedback loop that is selected from a group consisting of an analog control loop and a digital control loop.

67. The active matrix display of claim 64, wherein a feedback data driver comprises:

a summation node; and a controller receiving an error signal from the summation node.

68. The active matrix display of claim 29, further comprising:

means for selecting a row of pixel elements.

69. The active matrix display of claim 29, further comprising:

means for driving a given pixel element in a selected row in a negative feedback loop.

70. An active matrix display comprising:

an array of selection driving lines;

an array of data driving lines crossing the array of selection driving lines;

an array of sensing output lines crossing the array of selection driving lines; and a matrix of pixel elements, wherein a pixel element electrically connects to at least one selection driving line, the pixel element comprises, a light emitting diode, a resistor electrically connecting to the light emitting diode, a data input electrically connecting to a data driving line, the data input receiving a data signal that changes a current flowing through the light emitting diode when the data input is enabled, a sensing output connecting to a sensing output line, and means for generating a sensing signal on the sensing output when the sensing output is enabled, and wherein a change in a current flowing through both the light emitting diode and the resistor induces a change in the sensing signal.

71. The active matrix display of claim 70, further comprising:

a plurality of feedback data drivers, wherein a feedback data driver electrically connects to a data driving line and a sensing output line, the data driving line and the sensing output line connect to a column of pixel elements, the feedback data driver detects a sensing signal on the sensing output line and outputs a data signal on the data driving line, and when a given pixel element is selected from the column of pixel elements, the feedback data driver is operable to drive the given pixel element in a negative feedback loop.

72. An active matrix display comprising:

an array of selection driving lines;

an array of data driving lines crossing the array of selection driving lines;

an array of sensing output lines crossing the array of selection driving lines; and a matrix of pixel elements wherein a pixel element comprises, a first switching transistor having a gate, a source, and a drain, and a semiconductor channel between the source thereof and the drain thereof, wherein the gate of the first switching transistor electrically connects to a selection driving line, a second switching transistor having a gate, a source, and a drain, and a semiconductor channel between the source thereof and the drain thereof, wherein the gate of the second switching transistor electrically connects to a selection driving line, a biasing transistor having a gate, a source, and a drain, and a semiconductor channel between the source thereof and the drain thereof, wherein the gate of the biasing transistor electrically connects to a data driving line through the semiconductor channel of the first switching transistor, a storage capacitor electrically connecting to the gate of the biasing transistor, a light emitting diode electrically connecting to the semiconductor channel of the biasing transistor, a resistor having a first terminal and a second terminal, the first terminal of the resistor electrically connecting to the light emitting diode, the second terminal of the resistor electrically connecting to a common voltage, and wherein the first terminal of the resistor electrically connects to a sensing output line through the semiconductor channel of the second switching transistor.

73. The active matrix display of claim 72, wherein the first terminal of the sensing resistor electrically connects to the light emitting diode through the semiconductor channel of the biasing transistor.

74. The active matrix display of claim 72, wherein the first terminal of the sensing resistor connects to the light emitting diode directly.

75. The active matrix display of claim 72, further comprising:

a plurality of feedback data drivers, wherein a feedback data driver electrically connects to a data driving line and a sensing output line, the data driving line and the sensing output line connect to a column of pixel elements, the feedback data driver detects a sensing signal on the sensing output line and outputs a data signal on the data driving line, and when a given pixel element is selected from the column of pixel elements, the feedback data driver is operable to drive the given pixel element in a negative feedback loop.

76. The active matrix display of claim 72, wherein a feedback data driver comprises:

a summation node; and a controller receiving an error signal from the summation node.

77. The active matrix display of claim 72, further comprising:

means for selecting a row of pixel elements.

78. The active matrix display of claim 72, further comprising:

means for driving a given pixel element in a selected row in a negative feedback loop.

79. An active matrix display comprising:

an array of selection driving lines;

an array of data driving lines crossing the array of selection driving lines;

an array of sensing output lines crossing the array of selection driving lines; and a matrix of pixel elements wherein a pixel element comprises, a first switching transistor having a gate, a source, and a drain, and a semiconductor channel between the source thereof and the drain thereof, wherein the gate of the first switching transistor electrically connects to a selection driving line, a second switching transistor having a gate, a source, and a drain, and a semiconductor channel between the source thereof and the drain thereof, wherein the gate of the second switching transistor electrically connects to a selection driving line, a biasing transistor having a gate, a source, and a drain, and a semiconductor channel between the source thereof and the drain thereof, wherein the gate of the biasing transistor electrically connects to a data driving line through the semiconductor channel of the first switching transistor, a storage capacitor electrically connecting to the gate of the biasing transistor, a light emitting diode electrically connecting to the semiconductor channel of the biasing transistor, a resistor serially connecting to the light emitting diode and forms a compound component having a first terminal and a second terminal, and wherein the second terminal of the compound component electrically connects to a common voltage, and the first terminal of the compound component electrically connects to a sensing output line through the semiconductor channel of the second switching transistor.

80. The active matrix display of claim 79, further comprising:

a plurality of feedback data drivers, wherein a feedback data driver electrically connects to a data driving line and a sensing output line, the data driving line and the sensing output line connect to a column of pixel elements, the feedback data driver detects a sensing signal on the sensing output line and outputs a data signal on the data driving line, and when a given pixel element is selected from the column of pixel elements, the feedback data driver is operable to drive the given pixel element in a negative feedback loop.

81. The active matrix display of claim 79, wherein a feedback data driver comprises:

a summation node; and a controller receiving an error signal from the summation node.

82. The active matrix display of claim 79, further comprising:

means for selecting a row of pixel elements.

83. The active matrix display of claim 79, further comprising:

means for driving a given pixel element in a selected row in a negative feedback loop.

84. A method applied on an active matrix display, the active matrix display comprising an array of selection driving lines, an array of data driving lines crossing the array of selection driving lines, an array of sensing output lines being crossing the array of selection driving lines, and a matrix of pixel elements including at least one pixel element that comprises (a) a light emitting diode, (b) a resistor electrically connecting to the light emitting diode, (c) a monitoring point on a current path that passes through at least the light emitting diode and the resistor, (d) a sensing output operable to receive a sensing signal from the monitoring point when the sensing output is enabled, the sensing output electrically connecting to a sensing output line, (e) a data input operable to change a current flowing through the light emitting diode when the data input is enabled, the data input electrically connecting to a data driving line, and (f) at least one selection input electrically connecting to a selection driving line, the method comprising:

selecting a row of pixel elements in the matrix of pixel elements; and driving a given pixel element in the selected row with a feedback data driver in a negative feedback loop, wherein the driving comprises, receiving with the feedback data driver a sensing signal from a sensing output line electrically connecting to the sensing output of the given pixel element, wherein the sensing signal is related to a current flowing through both the light emitting diode and the resistor in the given pixel element, generating with the feedback data driver a data signal that depends on the sensing signal received from the given pixel element, and transmitting with the feedback data driver a data signal to a data driving line electrically connecting to the data input of the given pixel element to complete the negative feedback loop.

85. The method of claim 84, wherein driving a given pixel element in the selected row comprises:

driving a given pixel element in the selected row in the negative feedback loop that is selected from a group consisting of a proportional control loop, a proportional-integration control loop, and a proportional-integration-derivative control loop.

86. The method of claim 84, wherein driving a given pixel element in the selected row comprises:

driving a given pixel element in the selected row in the negative feedback loop that is selected from a group consisting of an analog control loop and a digital control loop.

87. The method of claim 84, wherein the generating with the feedback data driver a data signal that depends on the sensing signal received from the given pixel element comprises:

comparing a reference signal with a corresponding signal that depends on the sensing signal received from the given pixel element;

generating an error signal that depends on the difference between the reference signal and the corresponding signal; and generating a data signal that depends on the error signal.

88. The method of 87, wherein the comparing comprises:

comparing a reference signal with a corresponding signal that is proportional to the sensing signal received from the given pixel element.

89. The method of 87, wherein generating an error signal comprises:

generating an error signal that is proportional to a difference between the reference signal and the corresponding signal.

90. The method of 87, wherein generating a data signal that depends on the error signal comprises:

generating a data signal that is proportional to the error signal.

91. The method of claim 84, wherein the selecting a row of pixel elements comprises:

applying a selection signal to a selection driving line that electrically connects to the selection inputs of the pixel elements in the selected row.

92. The method of claim 84, wherein the selecting a row of pixel elements comprises:

applying a selection signal to a selection driving line that electrically connects to the selection inputs of the pixel elements in the selected row to enable the data inputs and the sensing outputs of the pixel elements in the selected row.

93. The method of claim 84, wherein a pixel element further includes a first selection input and a second selection input, the selecting a row of pixel elements comprises:

applying a first selection signal to a selection driving line that electrically connects to the first selection inputs of the pixel elements in the selected row to enable the data inputs of the pixel elements in the selected row; and applying a second selection signal to a selection driving line that electrically connects to the second selection inputs of the pixel elements in the selected row to enable the sensing outputs of the pixel elements in the selected row.

94. The method of claim 84, wherein the at least one pixel element further comprises:

a biasing transistor having a gate, a source, and a drain, and a semiconductor channel between the source thereof and the drain thereof, and wherein the light emitting diode electrically connects to the semiconductor channel through the source or the drain of the biasing transistor.

95. The method of claim 94, wherein the resistor comprises a first terminal and a second terminal, the monitoring point electrically connects to the first terminal of the resistor, and the second terminal of the resistor electrically connects to a common voltage.

96. The method of claim 95, wherein the light emitting diode comprises a first terminal and a second terminal, the first terminal of the light emitting diode connects to the first terminal of the resistor through the semiconductor channel of the biasing transistor.

97. The method of claim 95, wherein the light emitting diode comprises a first terminal and a second terminal, the first terminal of the light emitting diode connects to the first terminal of the resistor directly.

98. The method of claim 94, wherein the resistor serially connects to the light emitting diode and forms a compound component having a first terminal and a second terminal, the monitoring point electrically connects to the first terminal of the compound component, the second terminal of the compound component electrically connects to a common voltage.

99. The method of claim 84, wherein the at least one pixel element further comprises:

a sensing control circuit operable to enable and disable the sensing output of the at least one pixel element with a selection signal.

100. The method of claim 99, wherein the sensing control circuit receives the selection signal from a selection driving line.

101. The method of claim 99, wherein the sensing control circuit is configured such that the sensing output receives substantially no sensing signals from the monitoring point when the sensing output of the pixel element is disabled.

102. The method of claim 99, wherein the sensing control circuit comprises:

a switching transistor having a gate, a source, and a drain, and a semiconductor channel between the source thereof and the drain thereof, the gate of the switching transistor being controlled with the selection signal; and wherein the monitoring point electrically connects to the sensing output through the semiconductor channel of the switching transistor.

103. The method of claim 84, wherein the at least one pixel element further comprises:

means for controlling the sensing output of the pixel element such that the sensing output receiving a sensing signal from the monitoring point when the sensing output is enabled.

104. The method of claim 103, wherein the means for controlling the sensing output is configured to receive a selection signal from a selection driving line.

105. The method of claim 103, wherein the means for controlling the sensing output is configured such that the sensing output receives substantially no sensing signal from the monitoring point when the sensing output of the pixel element is disabled.

* * * * *